US007508361B2

(12) United States Patent
Uchino et al.

(10) Patent No.: US 7,508,361 B2
(45) **Date of Patent: *Mar. 24, 2009**

(54) DISPLAY DEVICE AND METHOD INCLUDING ELECTTRO-OPTICAL FEATURES

(75) Inventors: Katsuhide Uchino, Kanagawa (JP); Junichi Yamashita, Tokyo (JP); Tetsuro Yamamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 540 days.

This patent is subject to a terminal disclaimer.

(21) Appl. No.: 10/876,597

(22) Filed: Jun. 28, 2004

(65) Prior Publication Data

US 2004/0263057 A1 Dec. 30, 2004

(30) Foreign Application Priority Data

Jun. 30, 2003 (JP) ..... 2003-187768

(51) Int. Cl.
*G09G 3/30* (2006.01)

(52) U.S. Cl. ..... 345/76

(58) Field of Classification Search ..... 345/76, 345/82, 90, 100–103, 204; 313/500
See application file for complete search history.

(56) References Cited

U.S. PATENT DOCUMENTS

| | | | | |
|---|---|---|---|---|
| 6,876,345 | B2 * | 4/2005 | Akimoto et al. | 345/76 |
| 2003/0184509 | A1 * | 10/2003 | Chen et al. | 345/90 |
| 2004/0210557 | A1 * | 10/2004 | Uluakar et al. | 707/1 |
| 2005/0007357 | A1 * | 1/2005 | Yamashita et al. | 345/204 |
| 2007/0109232 | A1 * | 5/2007 | Yamamoto et al. | 345/77 |

* cited by examiner

*Primary Examiner*—Chanh Nguyen
*Assistant Examiner*—Calvin C Ma
(74) *Attorney, Agent, or Firm*—Oblon, Spivak, McClelland, Maier & Neustadt, P.C.

(57) ABSTRACT

A display device, and method of driving the same, enabling stable and accurate supply of a current having a desired value to the light emitting element of each pixel without regard not only to variation of the threshold values of the active elements inside the pixels, but also to variation of the mobilities and enabling display of a high quality image as a result, wherein a current transfer circuit samples and holds a reference current of a reference current supply line for a time of 20 H by turning on TFTs as fifth and sixth switchs before an auto-zero operation in pixel circuits in pixel units, and after an elapse of a 20 H period, outputs and transfers the sampled and held reference current Iref to the reference current transfer line by holding a TFT as a seventh switch in the on state for the period of 20 H after the TFTs as fifth and sixth switchs are turned off. The pixel circuits sequentially fetch the reference current Iref transferred to the reference current transfer line for the period of 1 H and perform the auto-zero operation.

12 Claims, 16 Drawing Sheets

FIG. 4A ws[1]: TFT24
FIG. 4B ws[2]
FIG. 4C az[1]: TFT23
FIG. 4D az[2]
FIG. 4E ds[1]: TFT22
FIG. 4F ds[2]
FIG. 4G Vg(TFT21)
1f
1H
LIGHT EMISSION
2/3 Vsig
2/3 Vsig
Vcc−Vth
AUTO ZERO PERIOD
(Vth CORRECTION PERIOD)

FIG. 10A $S_{134(TFT134)}$

FIG. 10B $S_{132(TFT132)}$

FIG. 10C $S_{133(TFT133)}$

FIG. 10D $S_{134(TFT134)}$

FIG. 10E $S_{132(TFT132)}$

FIG. 10F $S_{133(TFT133)}$

FIG. 10G $V_{c131}$

FIG. 10H $az_{[1](TFT123-1,125-1)}$

FIG. 10I $az_{[2](TFT123-2,125-2)}$

⋮

FIG. 10J $az_{[20](TFT123-20,125-20)}$

FIG. 10K $V_{c1211}$

FIG. 10L $V_{c1212}$

FIG. 10M $V_{c12120}$

FIG. 11A ws[1]:TFT124

FIG. 11B ws[2]

FIG. 11C az[1]:TFT123,125

FIG. 11D az[2]

FIG. 11E ds[1]:TFT122

FIG. 11F ds[2]

FIG. 11G Vg(TFT121)

DISPLAY DEVICE AND METHOD INCLUDING ELECTTRO-OPTICAL FEATURES

BACKGROUND OF THE INVENTION

1. Field of the Invention

The present invention particularly relates to an organic electroluminescence (EL) display or other image display devices comprised of pixel circuits, having electro-optical elements whose luminance is controlled by a current value, arranged in a matrix, in particular a so-called active matrix type image display device in which a value of a current flowing through an electro-optical element is controlled by an insulating gate type field effect transistor provided inside each pixel circuit.

2. Description of the Related Art

In an image display device, for example, a liquid crystal display, an image is displayed by arranging a large number of pixels in a matrix and controlling a light intensity for every pixel in accordance with image information to be displayed. The same is true for an organic EL display etc., but an organic EL display is a so-called self light emitting type display which has light emitting elements in the pixel circuits and has the advantages that the viewability is high in comparison with a liquid crystal display, no backlight is required, a response speed is high, etc. Further, it greatly differs from a liquid crystal display etc. in the point that the luminance of each light emitting element is controlled by the value of the current flowing through it to give tones of the emitted colors, that is, the light emitting elements are current controlled types.

An organic EL display, in the same way as a liquid crystal display, may be driven by the simple matrix system and the active matrix system, but while the former is simple in structure, it has problems such as the difficulty of realization of a large scale and high definition display. For this reason, there has been active development of the active matrix system controlling the current flowing through the light emitting element inside each pixel circuit by an active element provided inside the pixel circuit, generally, a thin film transistor (TFT).

FIG. 1 is a block diagram of the configuration of a general organic EL display device. This display device 1 has, as shown in FIG. 1, a pixel array 2 having pixel circuits (PXLC) 2*a* arranged in an m×n matrix, a horizontal selector (HSEL) 3, a write scanner (WSCN) 4, data lines DTL1 to DTLn selected by the horizontal selector 3 and supplied with data signals in accordance with the luminance information, and scanning lines WSL1 to WSLm selectively driven by the write scanner 4.

FIG. 2 is a circuit diagram of an example of the configuration of a pixel circuit 2*a* of FIG. 1 (refer to for example U.S. Pat. No. 5,684,365 and Japanese Unexamined Patent Publication (Kokai) No. 8-234683. The pixel circuit of FIG. 2 has the simplest circuit configuration among the many circuits which have been proposed and is a so-called two-transistor drive type circuit.

The pixel circuit 2*a* of FIG. 2 has a p-channel thin film field effect transistor (hereinafter, referred to as a "TFT") 11 and a TFT 12, a capacitor C11, and a light emitting element 13 constituted by an organic EL element. Further, in FIG. 2, DTL indicates a data line, and WSL indicates a scanning line. An organic EL element has a rectification property in many cases, so is sometimes referred to as an "organic light emitting diode" (OLED). The symbol of a diode is used for the light emitting element in FIG. 2 and other figures, but a rectification property is not always required for the organic EL element in the following explanation. In FIG. 2, the source of the TFT 11 is connected to a power supply potential Vcc (supply line of power supply voltage Vcc), and the cathode of the light emitting element 13 is connected to a ground GND. The pixel circuit 2*a* of FIG. 2 operates as follows.

Step ST1

When the scanning line WSL is made the selected state (low level here) and a write potential Vdata is applied to the data line DTL, the TFT 12 becomes conductive, the capacitor C11 is charged or discharged, and the gate potential of the TFT 11 becomes Vdata.

Step ST2

When the scanning line WSL is made the nonselected state (high level here), the data line DTL and the TFT 11 are electrically disconnected, but the gate potential of the TFT 11 is stably held by the capacitor C11.

Step ST3

The current flowing through the TFT 11 and the light emitting element 13 becomes a value in accordance with a gate-source voltage Vgs of the TFT 11. The light emitting element 13 continuously emits light with a luminance in accordance with the current value.

The operation of selecting the scanning line WSL and transferring the luminance information given to the data line to the interior of the pixel as in above step ST1 will be referred to as a "write operation" below. As explained above, in the pixel circuit 2*a* of FIG. 2, when once writing Vdata, the light emitting element 13 continues emitting light with a constant luminance in the period up to when next rewritten.

As explained above, in the pixel circuit 2*a*, by changing a gate application voltage of the drive transistor constituted by the TFT 11, the value of the current flowing through the light emitting element 13 is controlled. At this time, the source of the drive transistor of p-channel is connected to the power supply potential Vcc. This TFT 11 always operates in a saturated region. Accordingly, it becomes a constant current source having a value shown in equation 1.

$$Ids=1/2\cdot\mu(W/L)Cox(Vgs-|Vth|)^2 \quad (1)$$

where, μ indicates the mobility of the carriers, Cox indicates a gate capacitance per unit area, W indicates a gate width, L indicates a gate length, Vgs indicates the gate-source voltage of the TFT 11, and Vth indicates the threshold value Vth of the TFT 11.

In a simple matrix type image display device, each light emitting element emits light only at a selected instant, while in an active matrix type, as explained above, each light emitting element continues to emit light even after the end of the write operation. Therefore, this type becomes advantageous, especially in a large sized, high definition display, in the point that the peak luminance and the peak current of the light emitting elements can be lowered in comparison with the simple matrix type.

However, a TFT generally has a large variation in Vth and mobility μ. For this reason, even if the same input voltage is applied to gates of different drive transistors, the ON currents will vary. As a result, the uniformity of image quality ends up deteriorating.

A large number of pixel circuits have been proposed in order to solve this problem. A representative example is shown in FIG. 3 (refer to for example U.S. Pat. No. 6,229,506 and FIG. 3 of Japanese Unexamined Patent Publication (Kohyo) No. 2002-514320).

A pixel circuit 2*b* of FIG. 3 has p-channel TFT 21 to TFT 24, capacitors C21 and C22, and a light emitting element 25 constituted by an organic light emitting diode (OLED) 25.

Further, in FIG. 3, DTL indicates a data line, WSL indicates a scanning line, AZL indicates an auto-zero line, and DSL indicates a drive line.

The operation of this pixel circuit 2*b* will be explained below while referring to timing charts shown in FIGS. 4A to 4G. FIG. 4A shows a scanning signal ws[1] applied to a scanning line WSL1 of the first row of the pixel array; FIG. 4B shows a scanning signal ws[2] applied to a scanning line WSL2 of the second row of the pixel array; FIG. 4C shows an auto-zero signal az[1] applied to an auto-zero line AZL1 of the first row of the pixel array; FIG. 4D shows an auto-zero signal az[2] applied to an auto-zero line AZL2 of the second row of the pixel array; FIG. 4E shows a drive signal ds[1] applied to a drive line DSL1 of the first row of the pixel array; FIG. 4F shows a drive signal ds[2] applied to a drive line DSL2 of the second row of the pixel array; and FIG. 4G shows a gate potential Vg of the TFT 21. Note that, in the following description, the operation of the pixel circuit of the first row will be explained.

As shown in FIGS. 4C and 4E, the drive signal ds[1] to the drive line DSL1 and the auto-zero signal az[1] to the auto-zero line AZL1 are made the low level, and the TFT 22 and the TFT 23 are made the conductive state. At this time, the TFT 21 is connected to the light emitting element (OLED) 25 in a diode-connected state, so the current flows through the TFT 21. At this time, the gate potential Vg of the TFT 21 falls as shown in FIG. 4G.

As shown in FIG. 4E, the drive signal ds[1] to the drive line DSL1 is made the high level, and the TFT 22 is made the nonconductive state. At this time, the scanning signal ws[1] to the scanning line WSL1 is the high level and the TFT 24 is held in the nonconductive state as shown in FIG. 4A. Along with the TFT 22 becoming the nonconductive state, the current flowing through the light emitting element 25 is cut off, therefore, as shown in FIG. 4G, the gate potential Vg of the TFT 21 rises, but the TFT 21 becomes the nonconductive state at the point of time when the potential rises up to Vcc−|Vth| and therefore the potential becomes stable. This operation will be referred to as an "auto-zero operation".

As shown in FIG. 4C, after the auto-zero signal az[1] to the auto-zero line AZL1 is made the high level, the TFT 23 is made the nonconductive state, and the auto-zero operation (Vth correction operation) is terminated, the drive signal ds[1] to the drive line DSL1 is made the low level and the TFT 22 is made the conductive state.

Then, the scanning signal ws[1] to the scanning line WSL1 is made the low level to make the TFT 24 the conductive state as shown in FIG. 4A and thereby apply the data signal of a predetermined potential propagated to the data line DTL1 to the capacitor C21. Due to this, as shown in FIG. 4G, the gate potential of the TFT 21 is lowered by exactly ΔVg via the capacitor C21. As shown in FIG. 4A, the TFT 24 is made the nonconductive state by making the scanning line WSL1 the high level. Due to this, the current flows through the TFT 21 and the light emitting element (OLED) 25, so the light emitting element 25 starts emitting light.

Summarizing the problems to be solved by the invention, as mentioned above, in the pixel circuit of FIG. 3, by turning on the auto-zero switch constituted by the TFT 23 while the light emitting element 25 is not emitting light, the drive transistor TFT 21 is cut off. In the cut off state, current does not flow through this TFT 21, so the gate-source voltage Vgs becomes equal to the threshold value Vth of the transistor. Due to this, variation in the Vth for each pixel is cancelled. Next, by turning off the TFT 23, then turning on the TFT 24, the voltage ΔV is coupled with the data line voltage at the gate of the drive transistor TFT 21 through the capacitor C21 in the pixel. When this coupling amount is V0, the drive transistor TFT 21 carries an ON current corresponding to Vgs−Vth=V0 regardless of the Vth and therefore an image quality without unevenness in uniformity due to variation in the Vth is obtained.

In the pixel circuit of FIG. 3, however, even if the variation in Vth can be corrected, the variation of the mobility p cannot be corrected. Below, this problem will be explained in further detail in relation to the drawings.

FIG. 5 is a graph showing characteristic curves of ΔV (=Vgs−Vth) and the drain-source current Ids of drive transistors having different mobilities in the pixel circuits of FIG. 3. In FIG. 5, an abscissa represents the voltage ΔV, and an ordinate represents the current Ids. Further, in FIG. 5, the curve indicated by the solid line shows the characteristic of a pixel A, and the curve indicated by a broken line shows the characteristic of a pixel B.

As shown in FIG. 5, the mobility differs between the characteristic of the pixel A indicated by the solid line and the characteristic of the pixel B indicated by the broken line. In the pixel circuit system of FIG. 3, at the auto-zero point (ΔV=V0), the current value is equal even between pixel transistors having different mobilities. However, as the voltage rises thereafter, the variation of the mobility μ ends up appearing in the current value. For example, in the pixel A and the pixel B having different mobilities, even when the same voltage ΔV=V0 is applied, variation of the current Ids occurs according to equation 1, so the luminances of the pixels end up differing. That is, as more current flows and the luminance increases, the current value ends up being affected by the variation of the mobility, the uniformity declines, and therefore the image quality ends up deteriorating.

FIG. 6 is a graph of the change of the gate voltage of the drive transistor at the time of an auto-zero operation of pixels C and D having different drive transistor threshold values Vth. In FIG. 6, the abscissa represents a time t, and the ordinate represents the gate voltage Vg. Further, in FIG. 6, the curve indicated by the solid line shows the characteristic of the pixel C, and the curve indicated by the broken line shows the characteristic of the pixel D.

The auto-zero operation is carried out by connecting the gate and the source of the drive transistor, but the closer to the cutoff region, the more rapidly the ON current decreases. For this reason, a long time is required until the cut off is completed and the variation of the threshold value is cancelled out. As shown in FIG. 6, if the auto-zero time is insufficient, the variation of the threshold value Vth is not completely cancelled in the pixel C. In this way, it is believed that due to the variation of the threshold values Vth, the writing state of the gate voltage also varies and the uniformity deteriorates due to this as well.

Further, even if sufficient auto-zero time is taken and the variation of the threshold values Vth is cancelled out, an off current, though small, ends up flowing through the drive transistor after the cutoff. For this reason, as shown in FIG. 7, the gate voltage ends up gradually rising toward the power supply voltage Vcc. As a result, irrespective of the fact that the variation of the threshold values Vth is once cancelled out by the auto-zero operation, in the end, the gate potentials of the pixels with the varied threshold values Vth head toward the power supply voltage, so the variation of the threshold values Vth appears again.

From the above, in an actual device, in order to effectively cancel out variation of the threshold values Vth, it is necessary to optimally adjust the auto-zero period for every panel. Optimum adjustment of the auto-zero period for every panel, however, would require an enormous adjustment time and would end up increasing the cost of the panels.

SUMMARY OF THE INVENTION

An object of the present invention is to provide a display device and method of driving the same enabling stable and accurate supply of a current having a desired value to the light emitting element of each pixel without regard not only to variation of the threshold values of the active elements inside the pixels, but also to variation of the mobilities and enabling display of a high quality image as a result.

To attain the above object, according to a first aspect of the present invention, there is provided a display device having a plurality of pixel circuits arranged in a matrix, at least one data line laid for the column for the matrix array of the pixel circuits and supplied with data signals in accordance with luminance information, a first control line laid for every row for the matrix array of the pixel circuits, first and second reference potentials, and at least one reference current supply line laid for the column for the matrix array of the pixel circuits and supplied with predetermined reference current and forming a plurality of pixel units each including a plurality of pixel circuits arranged in the same column of the pixel array and connected to the same data line; each pixel unit including a reference current transfer line connected in common to the plurality of pixel circuits in the unit and a current transfer circuit for accumulating the reference currents supplied to the reference current supply line over a predetermined period and transferring the reference current accumulated after the elapse of the predetermined period to the reference current transfer line; each pixel circuit having an electro-optical element, first, second, and third nodes, a drive transistor forming a current supply line between a first terminal and a second terminal connected to the first node and controlling the current flowing through the current supply line in accordance with the potential of the control terminal connected to the second node, a first switch connected to the first node, a second switch connected between the first node and the second node, a third switch connected between the data line and the third node and controlled in its conduction by the first control line, a fourth switch connected between the first node and the reference current transfer line, and a coupling capacitor connected between the second node and the third node; and the current supply line of the drive transistor, the first node, the first switch, and the electro-optical element being connected in series between the first reference potential and second reference potential.

Preferably, each current transfer circuit has a field effect transistor having a source connected to a predetermined potential, a fifth switch connected between the drain and the gate of the field effect transistor, a sixth switch connected between the drain of the field effect transistor and the reference current supply line, a seventh switch connected between the drain of the field effect transistor and the reference current transfer line, and a capacitor connected between the gate of the field effect transistor and the predetermined potential.

Alternatively, each current transfer circuit has a first field effect transistor having a source connected to a predetermined potential, a second field effect transistor having a source connected to the drain of the first field effect transistor, a fifth switch connected between the drain and the gate of the second field effect transistor, a sixth switch connected between the drain of the second field effect transistor and the reference current supply line, a seventh switch connected between the drain of the second field effect transistor and the reference current transfer line, an eighth switch connected between the drain and the gate of the first field effect transistor, a first capacitor connected between the gate of the first field effect transistor and the predetermined potential, and a second capacitor connected between the gate of the second field effect transistor and the predetermined potential.

More preferably, the display device has a first circuit for making the fifth and sixth switches of the current transfer circuit conductive for a time of a multiple of the horizontal scanning period to input reference current supplied to the reference current supply line to accumulate them in the capacitor and make the field effect transistor act as a current source and holding the fifth and sixth switches in the nonconductive state after the elapse of the time of a multiple of the horizontal scanning period to make the seventh switch conductive and output the accumulated reference current to the reference current transfer line and a second circuit for sequentially making the fourth switches of the pixel circuits in the pixel units conductive for every horizontal scanning period to sequentially supply the reference current output from the current transfer circuit to the reference current transfer lines to the first nodes of the pixel circuits.

Alternatively, more preferably the display device further has a first circuit for making the fifth, sixth, and eighth switches of the current transfer circuit conductive for a time of a multiple of the horizontal scanning period to input reference current supplied to the reference current supply line and accumulate them in the first and second capacitors and make the first and second field effect transistors act as current sources and holding the fifth, sixth, and eighth switches in the nonconductive state after the elapse of the time of the multiple of the horizontal scanning period to make the seventh switch conductive and output the accumulated reference current to the reference current transfer line and a second circuit for sequentially making the fourth switches of the pixel circuits in the pixel units conductive for every horizontal scanning period to sequentially supply the reference current output from the current transfer circuit to the reference current transfer line to the first nodes of the pixel circuits.

Still more preferably, each current transfer circuit has a leakage elimination circuit for supplying a current corresponding to the accumulated reference current to the drain of the second field effect transistor during a period where the seventh switch is made the conductive state.

Still more preferably, when the second circuit drives an electro-optical element of a pixel circuit of a pixel unit, as a first stage, the first switch, the second switch, and the fourth switch are made conductive for a predetermined time to electrically connect the first node and the second node and the reference current is supplied to the first node from the reference current transfer line, as a second stage, the first switch is held in the nonconductive state and the second switch and the fourth switch are held in the nonconductive state after the elapse of the horizontal scanning period, and as a third stage, the third switch is made conductive by the first control line, the first switch is made conductive, the data propagated through the data line is written into the third node, then the third switch is held in the nonconductive state, and a current in accordance with the data signal is supplied to the electro-optical element.

Preferably, a value of the reference current is set at a value corresponding to an intermediate color of the generated light of the electro-optical element.

According to a second aspect of the invention, there is provided a driving method of a display device forming a plurality of pixel units each including a plurality of pixel circuits arranged in the same column of a pixel array and connected to same the data line, the pixel unit including a reference current transfer line connected in common to a plurality of pixel circuits in the unit and a current transfer circuit for accumulating the reference current supplied to the reference current supply line over a predetermined period and transferring the accumulated reference current to the reference current transfer line after the elapse of the predetermined period, each pixel circuit having an electro-optical element, first, second and third nodes, a drive transistor forming a current supply line between a first terminal and a second terminal connected to the first node and controlling the current flowing through the current supply line in accordance with the potential of the control terminal connected to the second node, a first switch connected to the first node, a second switch connected between the first node and the second node, a third switch connected between the data line and the third node, a fourth switch connected between the first node and the reference current transfer line, and a coupling capacitor connected between the second node and the third node, and the current supply line of the drive transistor, the first node, the first switch, and the electro-optical element being connected in series between the first reference potential and second reference potential, the driving method of a display device comprising the steps of accumulating the reference currents supplied to the reference current supply lines laid for every column for the matrix array of the pixel circuits for a predetermined period and transferring the accumulated reference currents to the reference current transfer line connected in common to a plurality of pixel circuits in the pixel units after the elapse of the predetermined period and sequentially making the fourth switches in the pixel circuits in the pixel units conductive for every horizontal scanning period and sequentially supplying the reference currents transferred to the reference current transfer lines to the first nodes of the pixel circuits.

According to the present invention, a reference current flows through for example a reference current supply line from a constant current source. For example, by the first circuit, the fifth and sixth switches of a current transfer circuit are held in the conductive state for a time of a multiple of the horizontal scanning period. Along with this, the reference current supplied to the reference current supply line is input into the pixel unit and accumulated in the capacitor. Due to this, the field effect transistor acts as a current source. Then, the fifth and sixth switches are held in the nonconductive state after the elapse of the time of the multiple of the horizontal scanning period by the first circuit, the seventh switch is held in the conductive state, and the accumulated reference current is output to the reference current transfer line. Then, by the second circuit, the fourth switches in the pixel circuits of the pixel units are sequentially held in the conductive state for every horizontal scanning period. Due to this, the reference currents output from the current transfer circuits to the reference current transfer lines are sequentially supplied to the first nodes of the pixel circuits.

Concretely, in each pixel circuit, the first switch, the second switch, and the fourth switch are held in the conductive state. Then, the first switch is made the nonconductive state. At this time, the second switch and the fourth switch turn on, the first node and the second node are connected to the reference current source through the reference current transfer line, and the reference current is drawn, therefore the gate voltage value of the drive transistor is set so that the ON current of the pixel coincides with the reference current. Due to this, correction (auto-zero operation) with respect to all pixels having various threshold values and mobilities is executed. Next, the second and fourth switches are made the nonconductive state to terminate the auto-zero operation (Vth correction operation), then for example the first switch is made the conductive state. Further, the third switch is made the conductive state by the first control line to apply the data signal having the predetermined potential propagated to the data line to the coupling capacitor. Due to this, the input data signal is coupled with the gate voltage of the drive transistor via the coupling capacitor, and the current of the value corresponding to the coupling voltage ΔV flows through the electro-optical element. Then, the third switch is made the nonconductive state.

BRIEF DESCRIPTION OF THE DRAWINGS

These and other objects and features of the present invention will become clearer from the following description of the preferred embodiments given with reference to the accompanying drawings, in which.

Figure 3:
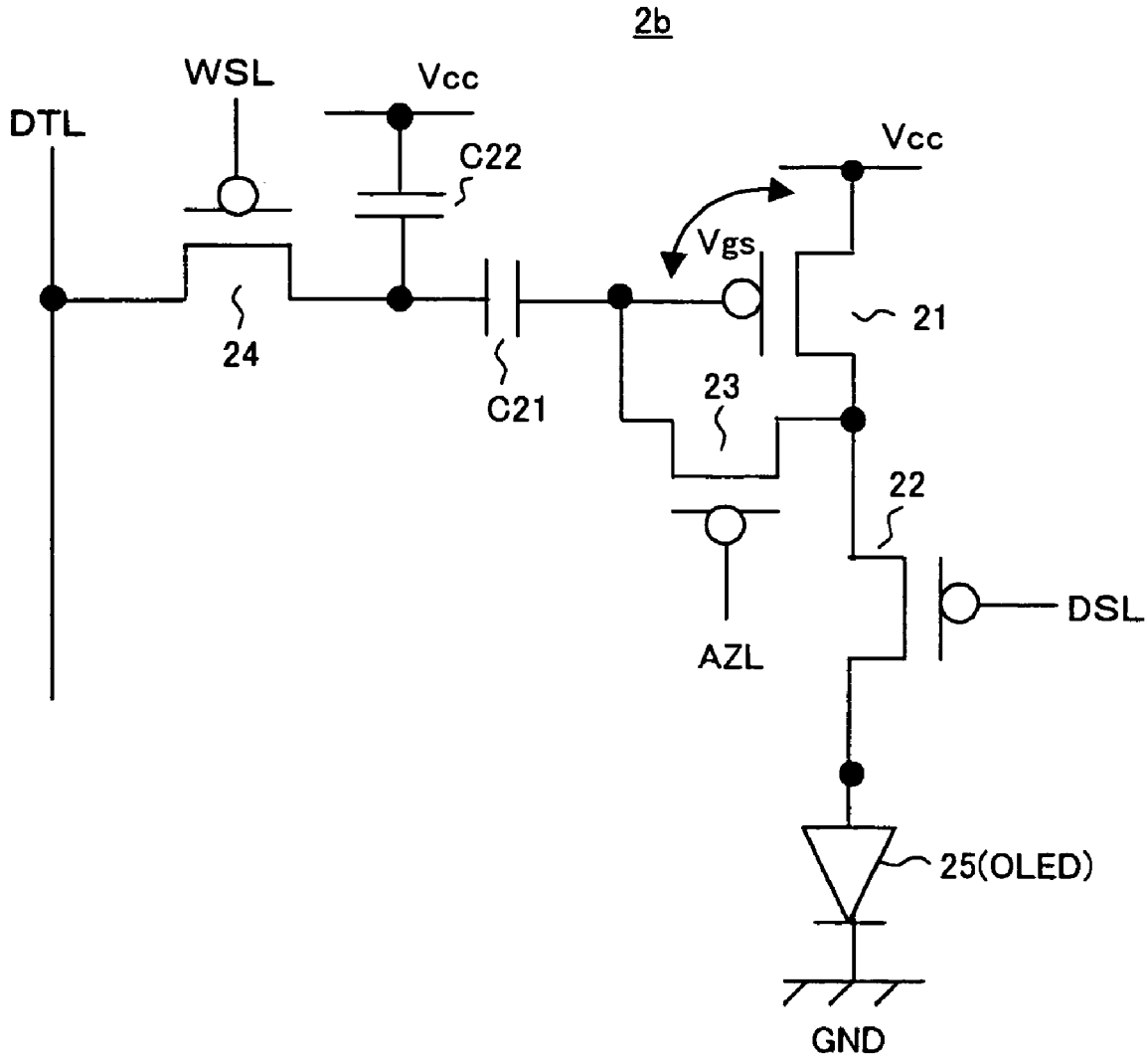
FIG. 3 is a circuit diagram of an example of the configuration of a pixel circuit having an auto-zero function.
Figure 4:
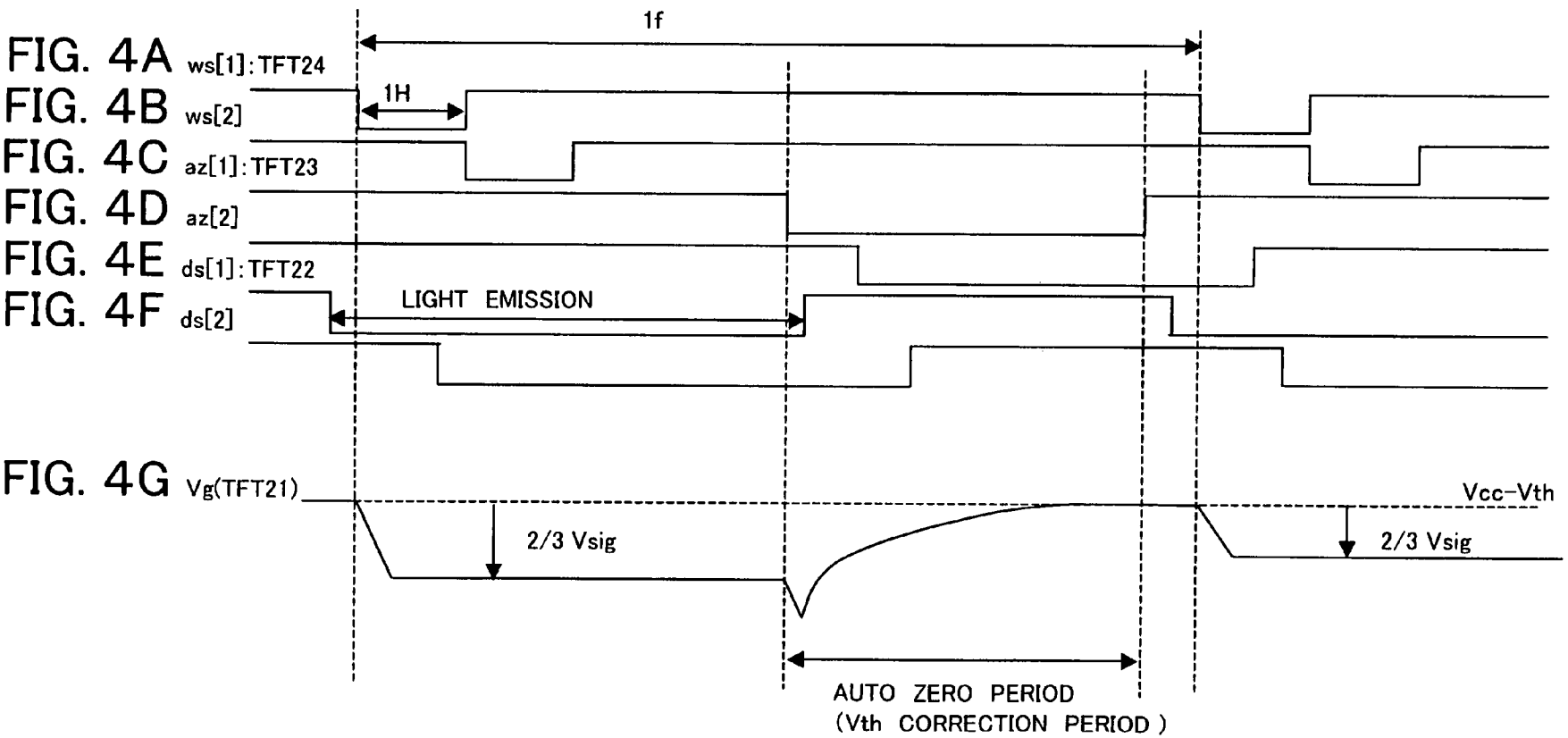
FIGS. 4A to 4G are timing charts for explaining the operation of the circuit of FIG. 3.
Figure 8:
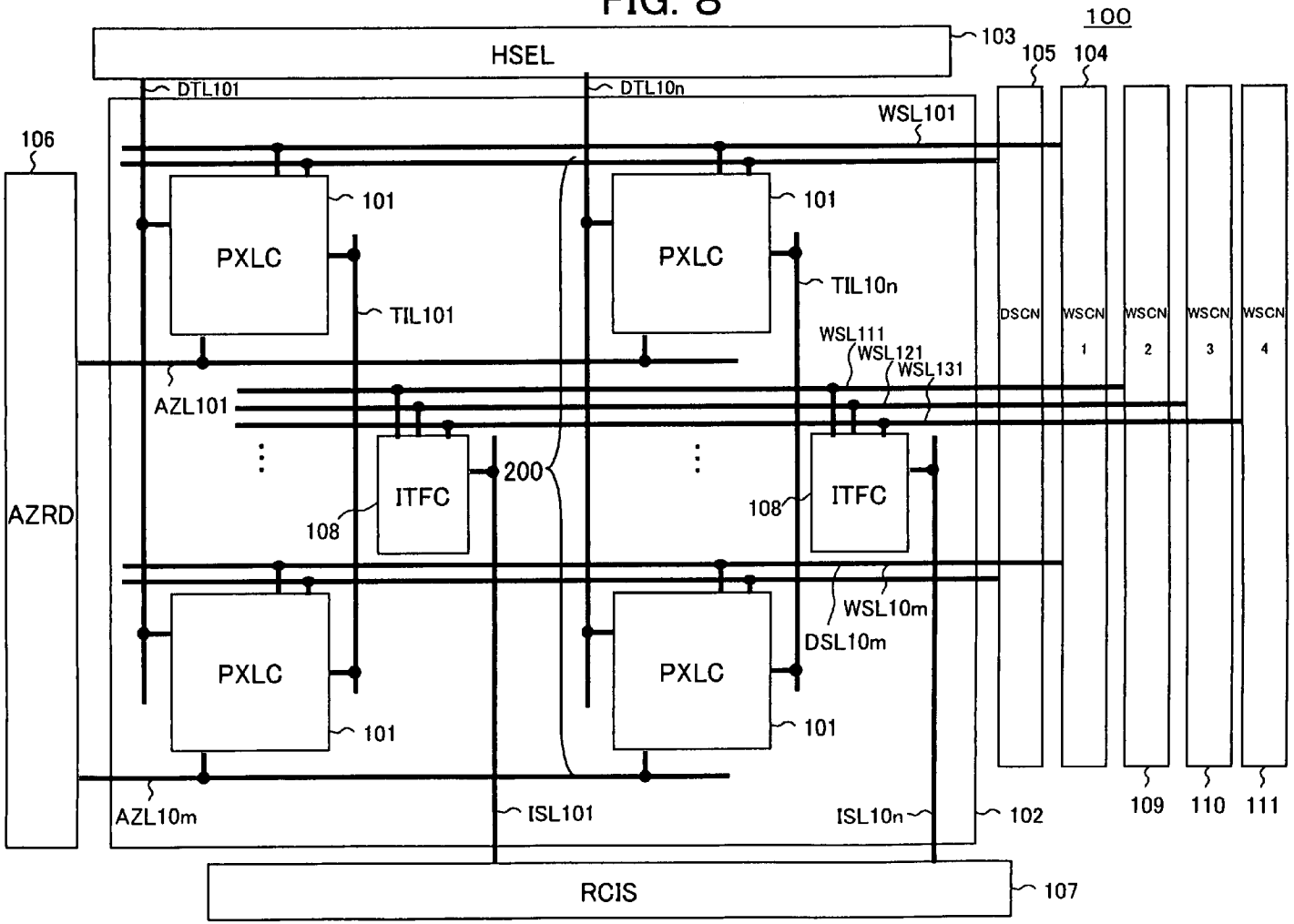
Figure 9:
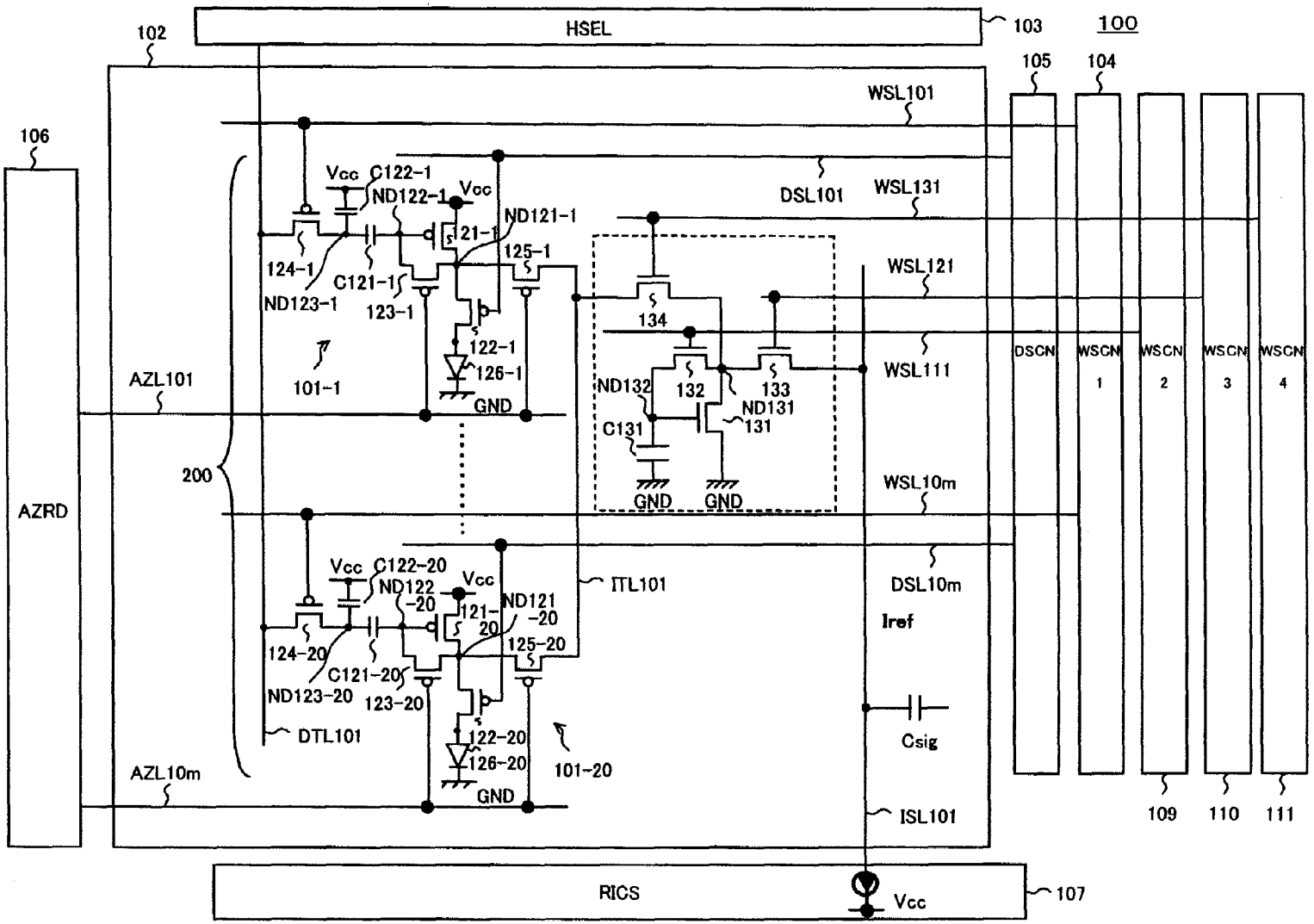
Figure 12:
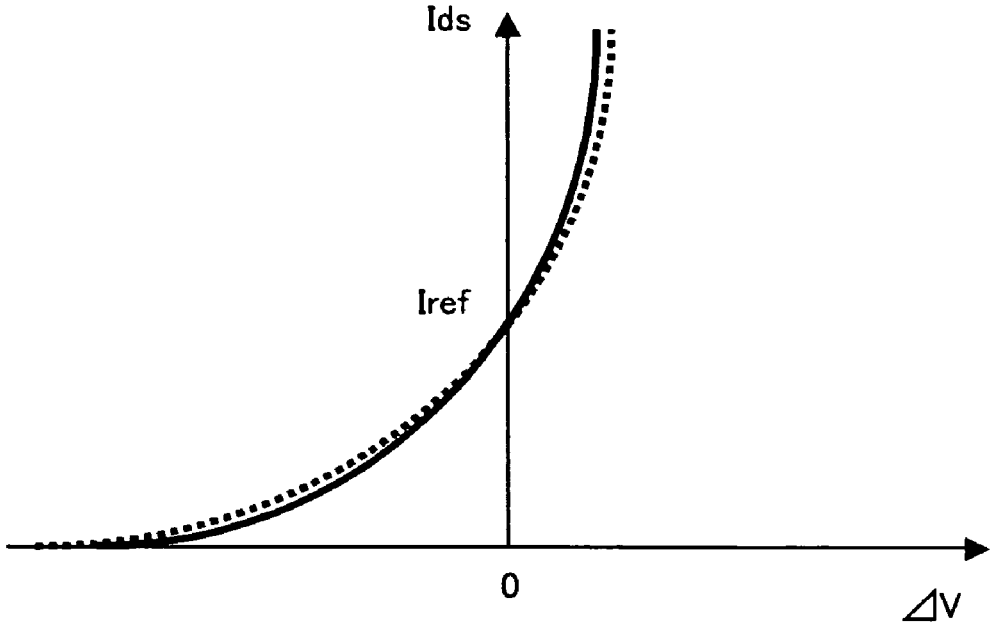
Figure 13:
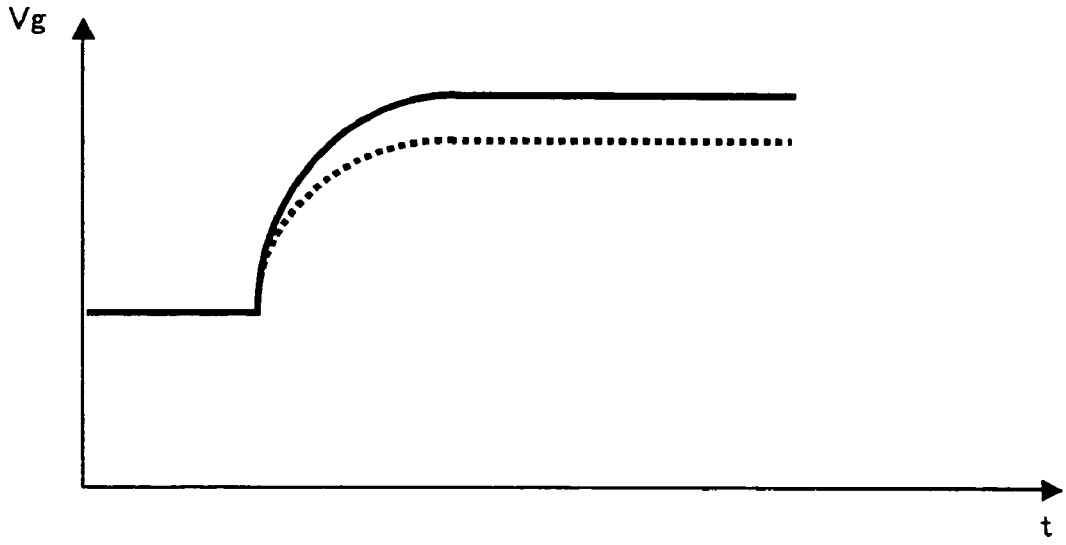
Figure 14B:
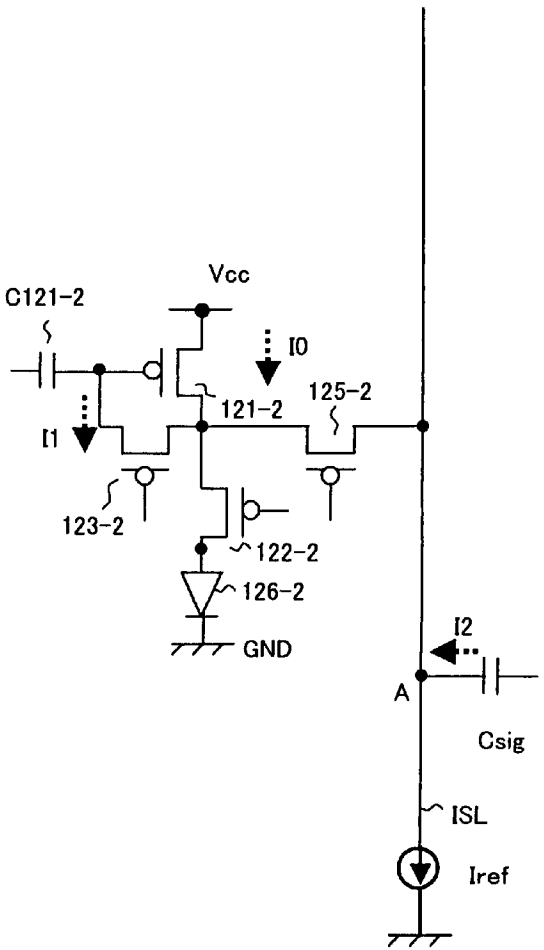
Figure 14A:
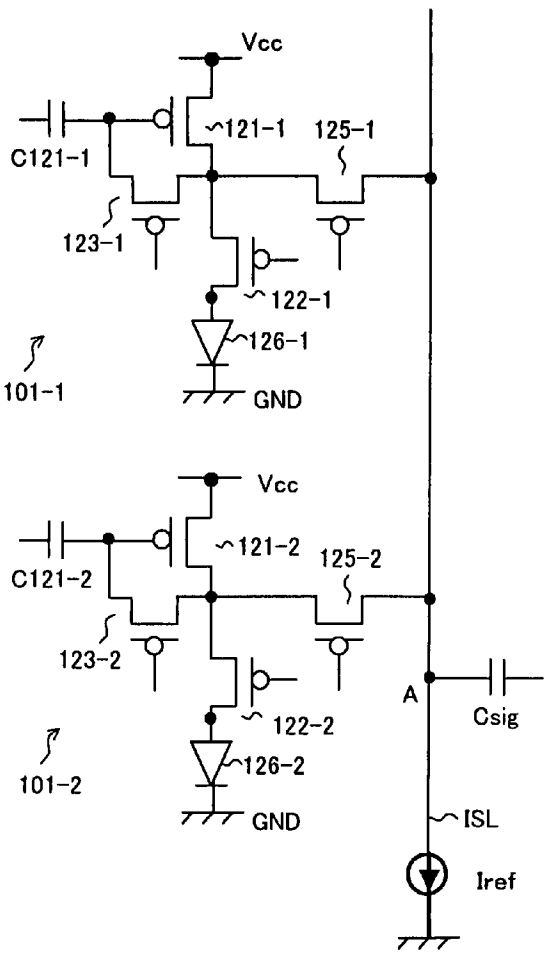
Figure 15:
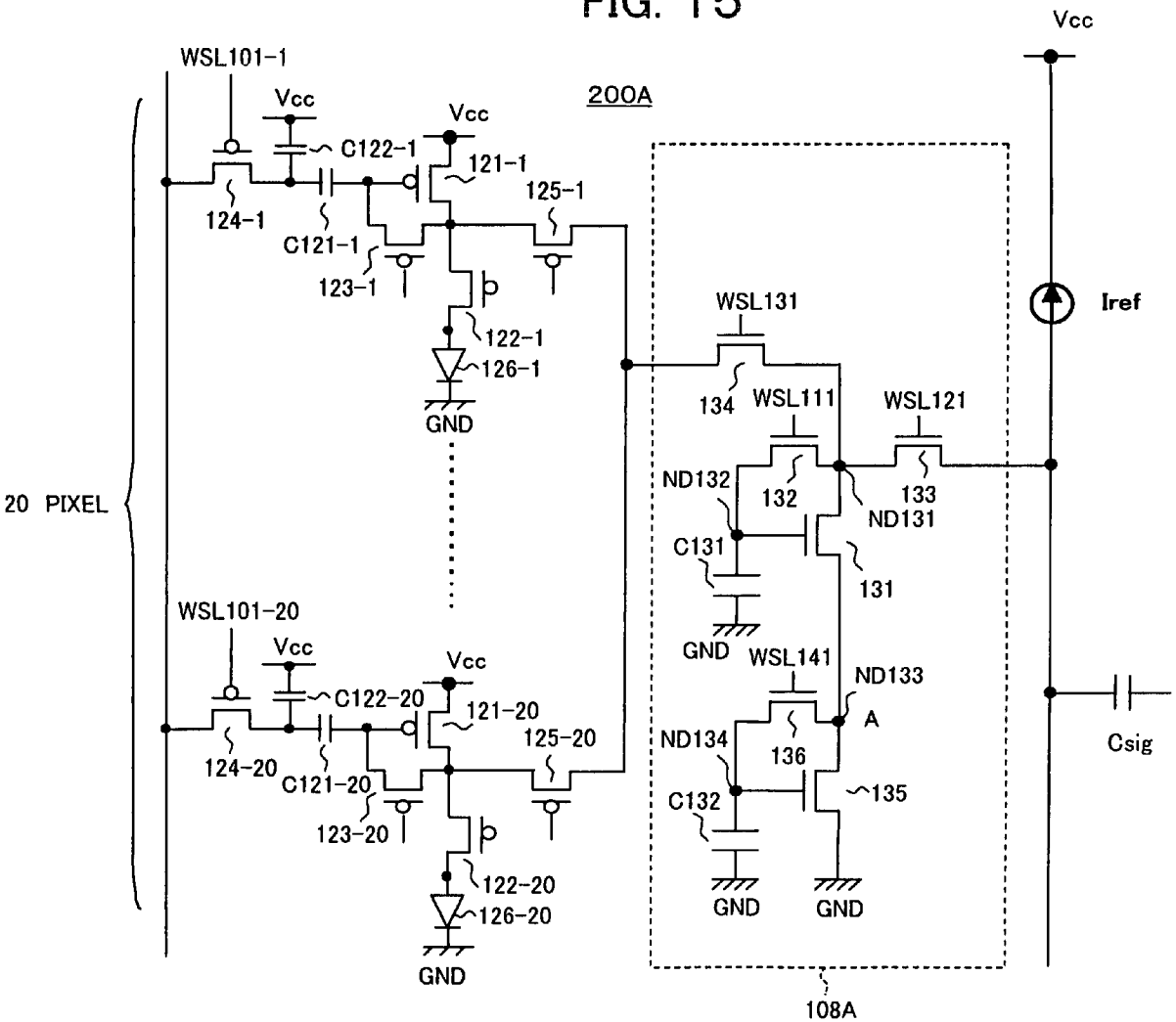
Figure 16:
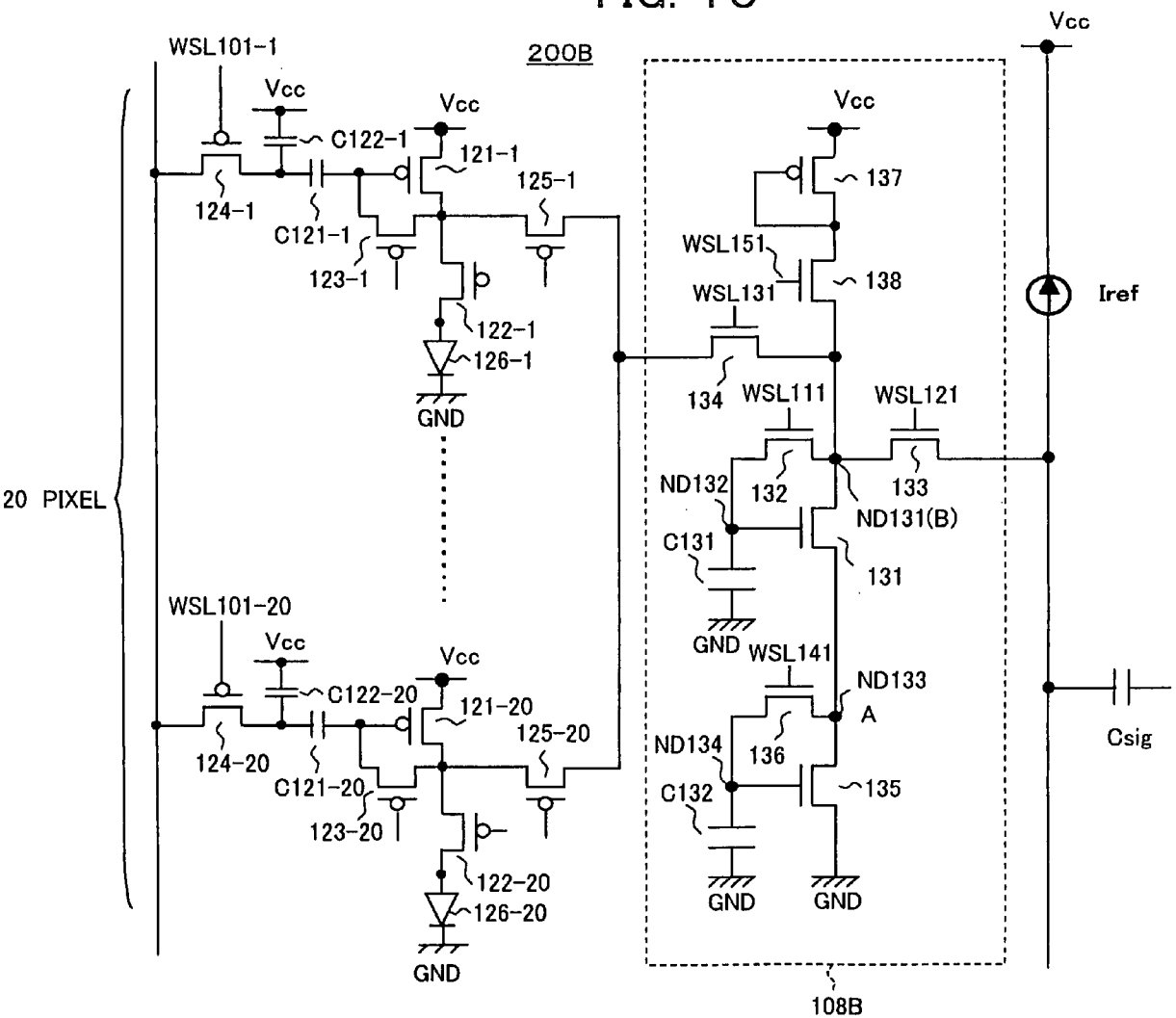

FIG, 7 is a view for explaining the problem of the circuit of FIG. 3;

FIG. 8 is a block diagram of the configuration of an organic EL display device according to the present invention;

FIG. 9 is a circuit diagram of the concrete configuration of a pixel circuit according to the present embodiment in the organic EL display device of FIG. 8;

FIGS. 10A to 10M are timing charts for explaining the operation of a pixel unit according to the present embodiment;

FIGS. 11A to 11G are timing charts for explaining the operation of a pixel circuit according to the present embodiment;

FIG. 12 is a graph of characteristic curves of ΔV (=Vgs−Vth) and a drain-source current Ids of drive transistors having different mobilities in the pixel circuit of FIG. 9;

FIG. 13 is a graph of the change of the gate voltage of a drive transistor at the time of an auto-zero operation in pixels having different drive transistor threshold values Vth in the pixel circuit of FIG. 9;

FIGS. 14A and 14B are circuit diagrams for explaining the advantages of the present embodiment;

FIG. 15 is a circuit diagram of another example of the configuration of a current transfer circuit in a pixel unit according to the present invention; and FIG. 16 is a circuit diagram of another example of the configuration of a current transfer circuit in a pixel unit according to the present invention.

DESCRIPTION OF THE PREFERRED EMBODIMENTS

Below, preferred embodiments of the present invention will be described with reference to the accompanying drawings.

FIG. 8 is a block diagram of an example of the configuration of an organic EL display device according to the present invention. FIG. 9 is a circuit diagram of a concrete configuration of a pixel circuit according to the present embodiment in the organic EL display device of FIG. 8.

This display device 100 has, as shown in FIG. 8 and FIG. 9, a pixel array 102 having pixel circuits (PXLC) 101 arranged in an m×n matrix, a horizontal selector (HSEL) 103, a first write scanner (WSCN1) 104, a drive scanner (DSCN) 105, an auto-zero circuit (AZRD) 106, a reference constant current source (RCIS) 107, a plurality of current transfer circuits (ITFC) 108, a second write scanner (WSCN2) 109, a third write scanner (WSCN3) 110, a fourth write scanner (WSCN4) 111, data lines DTL101 to DTL10*n* selected by the horizontal selector 103 and supplied with data signals in accordance with the luminance information, scanning lines WSL101 to WSL10*m* selectively driven by the first write scanner 104, drive lines DSL101 to DSL10*m* selectively driven by the drive scanner 105, auto-zero lines AZL101 to AZL10*m* selectively driven by the auto-zero circuit 106, reference current supply lines ISL101 to ISL10*n* supplied with the reference currents by the constant current source 107, a scanning line WSL111 selectively driven by the second write scanner 109, a scanning line WSL121 selectively driven by the third write scanner 110, and a scanning line WSL131 selectively driven by the fourth write scanner 111.

Among these components, the horizontal selector 103, the first write scanner 104, the drive scanner 105, and the auto-zero circuit 106 configure the second circuit according to the present invention, and the second, third, and fourth write scanners 109, 110, and 111 configure the first circuit according to the present invention.

Note that, in the pixel array 102, the pixel circuits 101 are arranged in an m×n matrix, but FIG. 8 shows an example of arranging the pixel circuits in a 2×2 matrix for simplification of the illustration. Further, FIG. 8 shows the concrete configuration of two pixel circuits for simplification of the illustration.

The present embodiment is configured forming a plurality of pixel units each comprised of a plurality of pixel circuits among the plurality of (for example 800) pixel circuits 101 arranged in the same column of the pixel array and connected to the same data line DTL, providing a current transfer circuit 108 in each pixel unit, connecting the current transfer circuits 108 and reference current supply lines ISL101 to ISL10*n*, sampling and holding a reference current Iref at the current transfer circuit 108 for every pixel unit, then sequentially supplying it to each pixel circuit 101 in the pixel unit at every horizontal scanning period. In the present embodiment, one pixel unit is configured by for example 20 pixel circuits. FIG. 8 and FIG. 9 show one pixel unit 200.

Each pixel unit 200 has 20 pixel circuits 101-1 to 101-20 arranged in the same column and connected to the same data line DTL101, a current transfer circuit 108, and a reference current transfer line ITL101 for transferring the output current of the current transfer circuit 108 to the pixel circuits 101-1 to 101-20. The reference current transfer line ITL101 is connected via the TFT 125-1 to TFT 125-20 serving as the fourth switches of the pixel circuits 101-1 to 101-20 to the first nodes ND121-1 to ND121-20.

Figure 1:
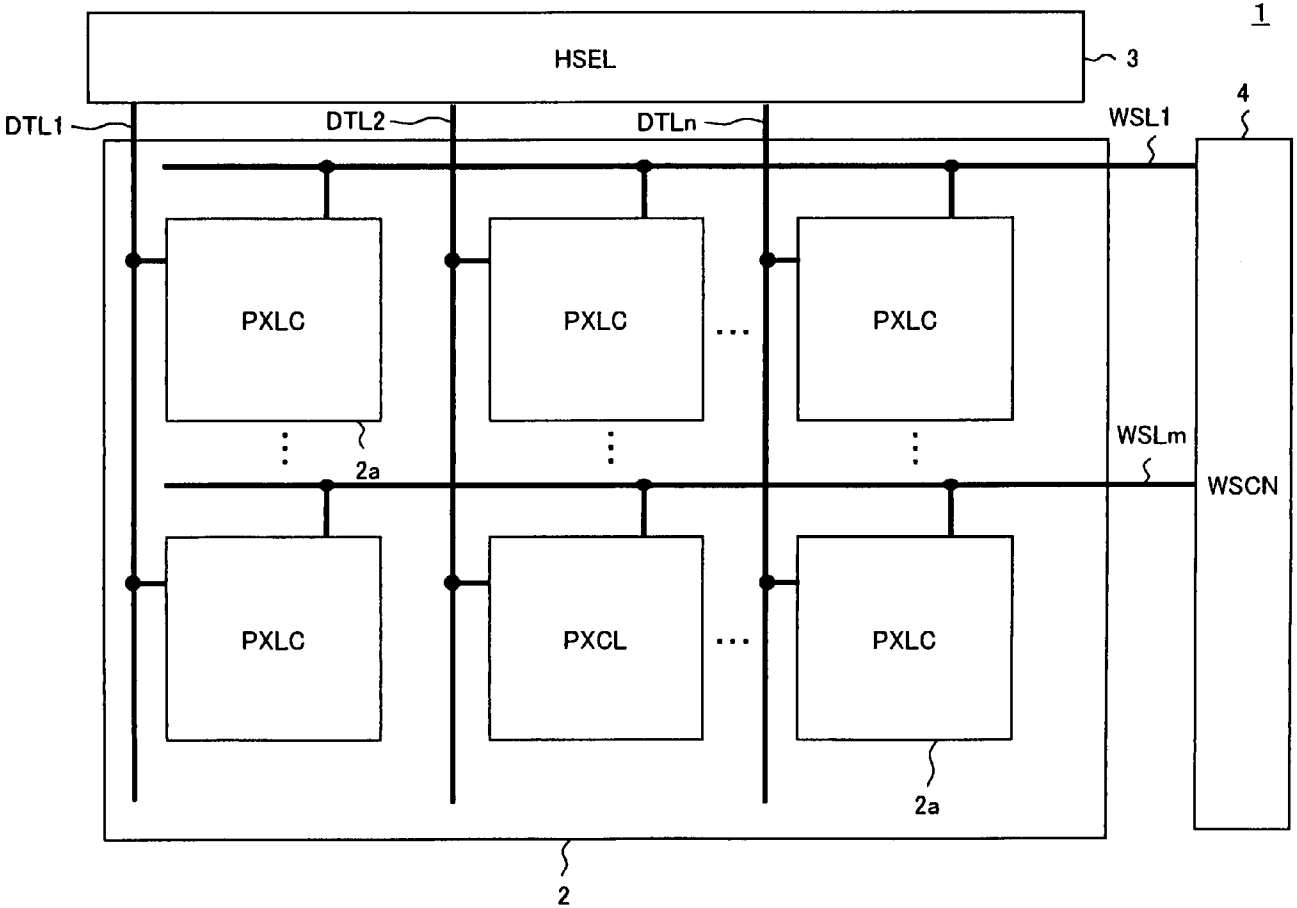
FIG. 1 is a block diagram of the configuration of a general organic EL display device.
Figure 2:
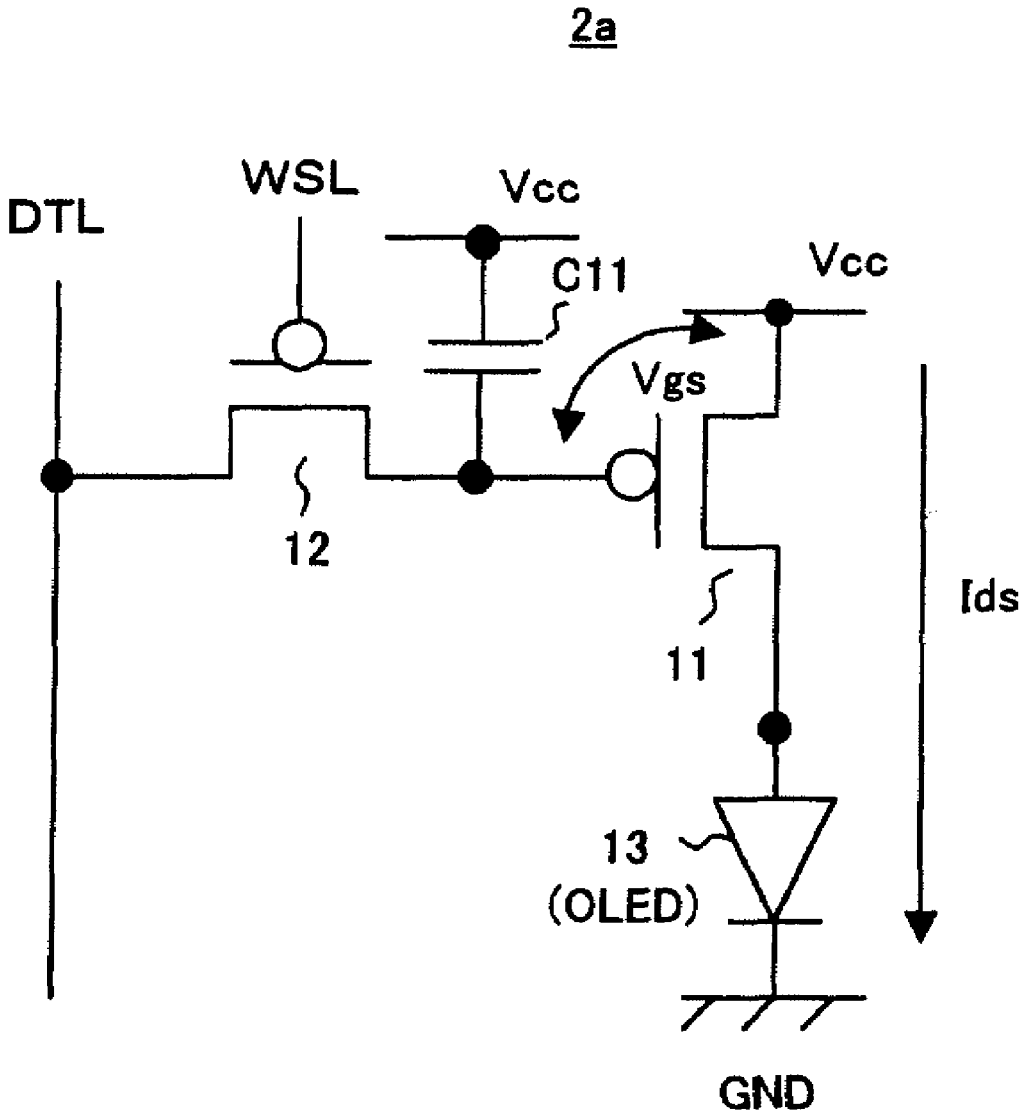
FIG. 2 is a circuit diagram of an example of the configuration of the pixel circuit of FIG. 1.

Each pixel circuit 101 (-1 to -20) according to the first embodiment concretely has, as shown in FIG. 2, p-channel TFT 121 (-1 to -20) to TFT 125 (-1 to -20), capacitors C121 (-1 to -20) and C122 (-1 to -20), a light emitting element 126 (-1 to -20) constituted by an organic EL emitting element (OLED), a first node ND121 (-1 to -20), a second node ND122 (-1 to -20), and a third node ND123 (-1 to -20). Further, in FIG. 9, DTL101 indicates the data line, WSL101, WSL111, WSL121, and WSL131 indicate scanning lines, DSL101 indicates a drive line, and AZL101 indicates an auto-zero line. Among these components, TFT 121 configures the drive transistor according to the present invention, TFT 122 configures the first switch, TFT 123 configures the second switch, TFT 124 configures the third switch, TFT 125 configures the fourth switch, and the capacitor C121 configures the coupling capacitor according to the present invention.

Further, the current source I107 and the reference current supply line ISL101 configure the current supplying means. Further, the reference current supply line ISL101 carries a reference current Iref (for example 2 μA). The reference current Iref is set at a current value corresponding to an intermediate color of the emitted light of the light emitting element 126 so as to be able to correct variation of the mobility. The scanning line WSL101 corresponds to the first control line according to the present invention, the drive line DSL101 corresponds to the second control line, and the auto-zero line AZL101 corresponds to the third control line (and the fourth control line). The supply line (power supply potential) of the power supply voltage Vcc corresponds to the first reference potential, and the ground potential GND corresponds to the second reference potential.

In the pixel circuit 101, the TFT 121, the first node ND121, the TFT 122, and the light emitting element 126 are connected in series between the power supply potential Vcc and the ground potential GND. Concretely, the source of the TFT 121 serving as the drive transistor is connected to the supply line of the power supply voltage Vcc, and the drain is connected to the first node ND121. The source of the TFT 122 serving as the first switch is connected to the first node ND121, and the drain is connected to the anode of the light emitting element 126. The cathode of the light emitting element 126 is connected to the ground potential GND. The gate of the TFT 121 is connected to the second node ND122, and the gate of the TFT 122 is connected to the drive line DSL101 serving as the second control line. The source and the drain of the TFT 123 serving as the second switch are connected to the first node ND121 and the second node ND122, and the gate of the TFT 123 is connected to the auto-zero line AZL101 serving as the third control line. The first electrode of the capacitor C121 is connected to the second node ND122, and the second electrode is connected to the third node ND123. Further, the first electrode of the capacitor C122 is connected to the third node ND123, and the second electrode is connected to the power supply potential Vcc. The source and the drain of the TFT 124 serving as the third switch are connected to the data line DTL101 and the third node ND123, and the gate of the TFT 124 is connected to the scanning line 101 serving as the first control line. Further, the source and the drain of the TFT 125 serving as the fourth switch are connected between the first node ND121 and the reference current transfer line ITL101 to which the reference current is output and transferred by the current transfer circuit 108, and the gate of the TFT 125 is connected to the auto-zero line AZL101 serving as the third control line.

The current transfer circuit 108 has, as shown in FIG. 9, n-channel TFT 131 to TFT 134, a capacitor C131, and nodes ND131 and ND132. Among these components, the TFT 131 configures the field effect transistor according to the present invention, the TFT 132 configures the fifth switch, the TFT 133 configures the sixth switch, and the TFT 134 configures the seventh switch.

The source of the TFT 131 is connected to the ground potential GND, the drain is connected to the node ND131, and the gate is connected to the node ND132. The source and the drain of the TFT 132 are connected to the node ND131 and the node ND132. The gate of the TFT 132 is connected to the scanning line WSL111 selectively driven by the second write scanner 109. The first electrode of the capacitor C131 is connected to the node ND132, and the second electrode is connected to the ground potential GND. The source and the drain of the TFT 133 are connected to the node ND131 and the reference current supply line ISL101. The gate of the TFT 132 is connected to the scanning line WSL121 selectively driven by the third write scanner 110. The source and the drain of the TFT 134 are connected to the node ND131 and the reference current transfer line ITL101. The gate of the TFT 134 is connected to the scanning line WSL131 selectively driven by the fourth write scanner 111.

In the pixel unit 200 having such a configuration, before performing the auto-zero operation in the pixel circuits 101-1 to 101-20 in the pixel unit 200, the current transfer circuit 108 samples and holds the reference current Iref supplied to the reference current supply line ISL101 for a time of 20 H (H is the horizontal scanning period) since the TFT 131 and the TFT 132 are held in the conductive (on) state. After 20 H passes and the TFT 131 and the TFT 132 are switched to the nonconductive (off) state, the TFT 134 is held in the on state for the period of for example 20 H, and the sampled and held reference current Iref is output and transferred to the reference current transfer line ITL101. The pixel circuits 101-1 to 101-20 sequentially fetch the reference current Iref transferred to the reference current transfer line ITL101 for the period of each 1 H and perform the auto-zero operation (correction operation of the threshold value Vth and the mobility μ).

Next, an explanation will be given of the operation of the above configuration in relation to FIGS. 10A to 10M and FIGS. 11A to 11G focusing on the operation of a pixel circuit.

Figure 10:
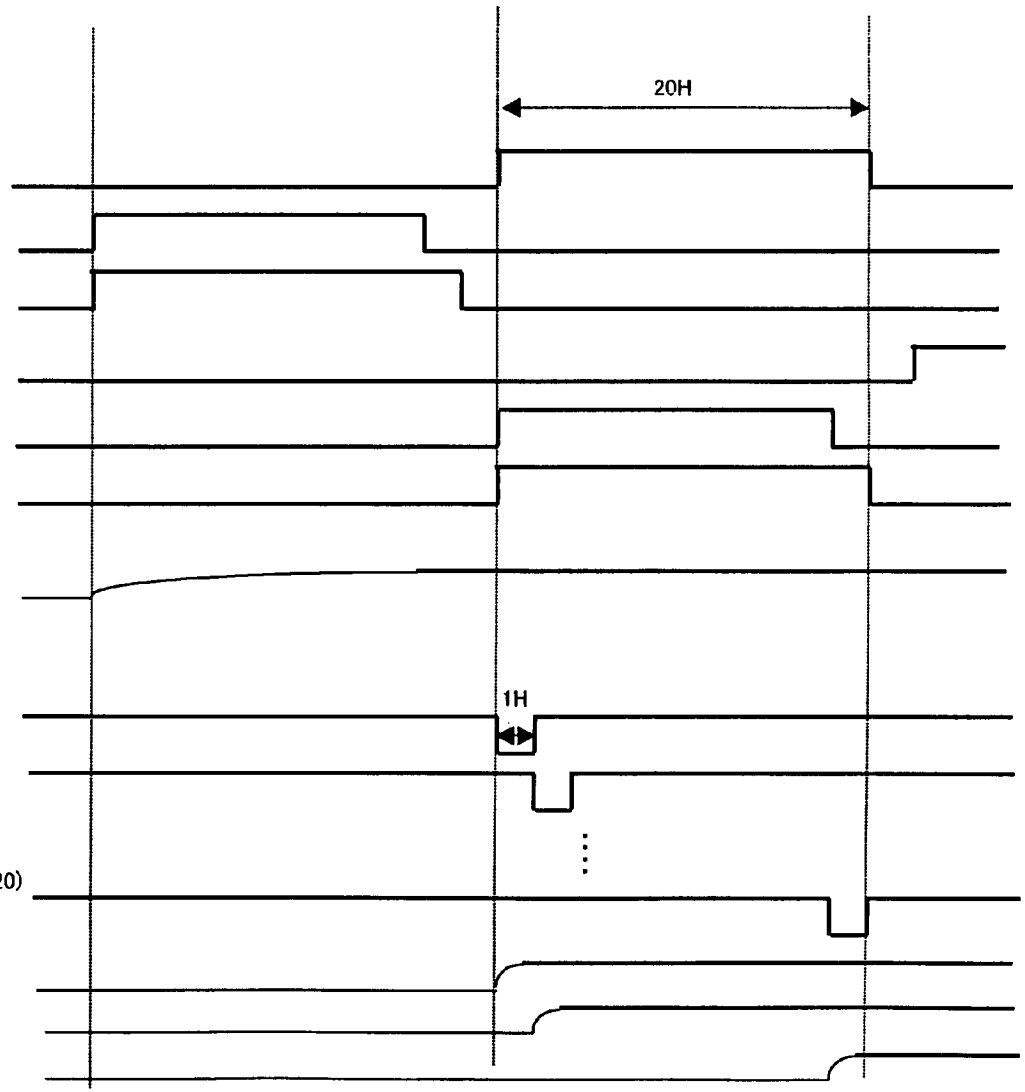

FIG. 10A shows a signal S134 applied to the scanning line WSL131 connected to the gate of the TFT 134 of the current transfer circuit 108; FIG. 10B shows a signal S132 applied to the scanning line WSL111 connected to the gate of the TFT 132; FIG. 10C shows a signal S133 applied to the scanning line WSL121 connected to the gate of the TFT 133; FIG. 10D shows a signal S134 applied to the scanning line WSL131 connected to the gate of the TFT 134 of the current transfer circuit 108 of another pixel unit; FIG. 10E shows a signal S132 applied to the scanning line WSL111 connected to the gate of the TFT 132 of another pixel unit; FIG. 10F shows a signal S133 applied to the scanning line WSL121 connected to the gate of the TFT 133 of another pixel unit; FIG. 10G shows a potential VC131 of the capacitor C131 of the current transfer circuit 108; FIG. 10H shows an auto-zero signal az[1] applied to the auto-zero line AZL101 of the first row of the pixel array; FIG. 10I shows an auto-zero signal az[2] applied to the auto-zero line AZL102 of the second row of the pixel array; FIG. 10J shows an auto-zero signal az[20] applied to the auto-zero line AZL102 of the 20th row of the pixel array; FIG. 10K shows a potential VC1211 of the capacitor 121-1 of the pixel circuit 101-1 of the first row of the pixel array; FIG. 10L shows a potential VC1212 of the capacitor C121-2 of the pixel circuit 101-2 of the second row of the pixel array; and FIG. 10M shows a potential VC12120 of the capacitor C121-20 of the pixel circuit 101-20 of the 20th row of the pixel array.

First, an explanation will be given focusing on the operation of a current transfer circuit.

The reference current supply line ISL101 carries a reference current Iref (for example 2 μA) by the constant current source 107. At this time, the fourth write scanner 111, as shown in FIG. 10A, makes the signal S134 to the scanning line WSL131 the low level to make the TFT 134 the nonconductive state. In this state, as shown in FIGS. 10B and 10C, the second and third write scanners 109 and 110 make the signals S132 and S133 to the scanning lines WSL111 and WSL121 the high level to make the TFT 132 and the TFT 133 the conductive state for the period of 20 H. Along with the TFT 132 and the TFT 133 becoming the conductive state, the reference current Iref flows through the current transfer circuit 108. At this time, the TFT 131 has its gate and drain connected via the TFT 132 and operates in the saturated region. The gate voltage thereof is determined based on equation 1 and held in the capacitor C131. After the predetermined gate voltage is written into the capacitor C131 and the interconnect capacitance Csig of the reference current line ISL101, for example, as shown in FIGS. 10B and 10C, the signal S132 to the scanning line WSL111 is made the low level to make the TFT 132 the nonconductive state, then the signal S133 to the scanning line WSL121 is made the low level to make the TFT 133 the nonconductive state.

Note that the interconnect capacitance Csig becomes larger proportional to the panel size, but there is one current transfer circuit 108 per 20 pixels, therefore a 20 H period can be used for writing the reference current Iref into the current transfer circuit 108. Due to this, even in a large screen panel, the reference current Iref can be sufficiently written in units of the pixel units and the Vth variation can be corrected.

Next, the writing of the reference current Iref from a current transfer circuit 108 to the pixel circuits 101-1 to 101-20 is started. Here, as shown in FIG. 10A, the signal S134 to the scanning line WSL131 is made the high level to hold the TFT 134 in the conductive state for a 20 H period. Due to this, the reference current Iref sampled and held in the current transfer circuit 108 and output to the reference current transfer line ITL101. Then, as shown in FIG. 10H, the signal az[1] to the auto-zero line AZL101-1 of the first row is set at the low level for exactly a 1 H period to write the reference current Iref into the first node ND121-1 of the pixel circuit 101-1, and the auto-zero operation (correction operation of the threshold value Vth and the mobility μ) is carried out. Next, as shown in FIG. 10I, the signal as[2] to the auto-zero line AZL101-2 of the second row is set at the low level for exactly a 1 H period to write the reference current Iref into the first node ND121-2 of the pixel circuit 101-2, and the auto-zero operation (correction operation of the threshold value Vth and the mobility μ) is carried out. Below, in the same way as above, as shown in FIG. 10J, the signal az[20] to the auto-zero line AZL101-20 of the 20th row is set at the low level for exactly a 1 H period to write the reference current Iref into the first node ND121-20 of the pixel circuit 101-20, and the auto-zero operation (correction operation of the threshold value Vth and the mobility p) is carried out.

In this case, the interconnect capacitance of the reference current transfer line ITL101 acting as the writing interconnect becomes as much as 20 pixels' worth of capacitance value. For this reason, the threshold value Vth correction can be sufficiently carried out even in a short time such as a 1 H period. Due to this, as will be explained below, even in a large screen panel, Vth variation based on the reference current Iref can be corrected, and an image quality of a high uniformity can be obtained.

Figure 11:
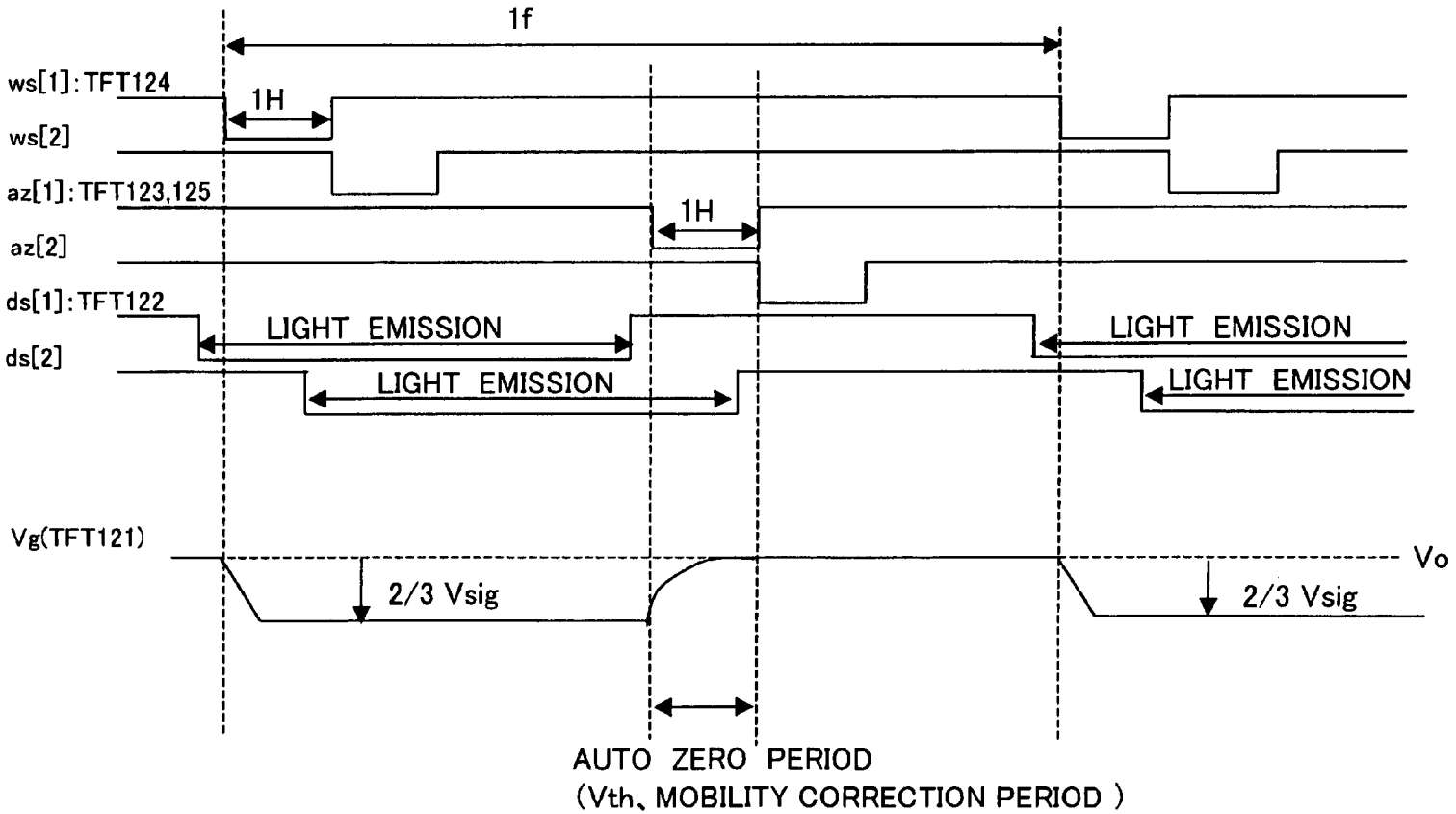

Next, an explanation will be given focusing on the operation of a pixel circuit in relation to FIGS. 11A to 11G. Note that, in the following description, the operation of the pixel circuit of the first row will be explained. FIG. 11A shows the scanning signal ws[1] applied to the scanning line WSL101 of the first row of the pixel array; FIG. 11B shows the scanning signal ws[2] applied to the scanning line WSL102 of the second row of the pixel array; FIG. 11C shows the auto-zero signal az[1] applied to the auto-zero line AZL101 of the first row of the pixel array; FIG. 11D shows the auto-zero signal az[2] applied to the auto-zero line AZL102 of the second row of the pixel array; FIG. 11E shows the drive signal ds[1] applied to the drive line DSL101 of the first row of the pixel array; FIG. 11F shows the drive signal ds[2] applied to the drive line DSL102 of the second row of the pixel array; and FIG. 11G shows the gate potential Vg of the TFT 121. Further, Vo indicates the gate voltage value of the drive transistor TFT 121 for supplying the reference current Iref.

As shown in FIGS. 11C and 11E, in the state where the drive signal ds[1] to the drive line DSL101 is at the high level (the TFT 122 is in the nonconductive state), the auto-zero signal az[1] to the auto-zero line AZL101 is made the low level, and the TFT 123 and the TFT 125 are made the conductive state.

At this time, the TFT 125 turns on, the first node ND121 and the second node ND122 are connected to the current source through the reference current transfer line ITL101, and the reference current Iref is drawn, so, as shown in FIG. 11G, the gate voltage value Vo of the drive transistor TFT 121 is set so that the ON current of the pixel matches with the reference current Iref. Due to this, correction (auto-zero operation) with respect to all pixels having various threshold values and mobilities μ is executed.

As shown in FIG. 11C, the auto-zero signal az[1] to the auto-zero line AZL101 is made the high level to make the TFT 123 and the TFT 125 the nonconductive state and terminate the auto-zero operation (Vth correction operation), then, as shown in FIG. 11E, the drive signal ds[1] to the drive line DSL101 is made the low level to make the TFT 122 the conductive state.

Then, the scanning signal ws[1] to the scanning line WSL101 is made the low level as shown in FIG. 11A to make the TFT 124 the conductive state, and a data signal of a predetermined potential propagated to the data line DTL101 is applied to the capacitor C121. Due to this, as shown in FIG. 11G, the input data signal is coupled with the gate voltage of the TFT 121 via the capacitor C121, and a current Ids of a value corresponding to the coupling voltage ΔV flows through the EL light emitting element 126 to cause it to emit light. Then, as shown in FIG. 11A, the scanning line WSL 101 is made the high level and the TFT 124 is made the nonconductive state.

FIG. 12 is a graph of characteristic curves of the ΔV (=Vgs−Vth) and the drain-source current Ids of drive transistors having different mobilities in the pixel circuits of FIG. 9. In FIG. 12, the abscissa represents the voltage ΔV, and the ordinate represents the current Ids. Further, in FIG. 12, the curve indicated by the solid line shows the characteristic of the pixel A, and the curve indicated by the broken line shows the characteristic of the pixel B.

Figure 5:
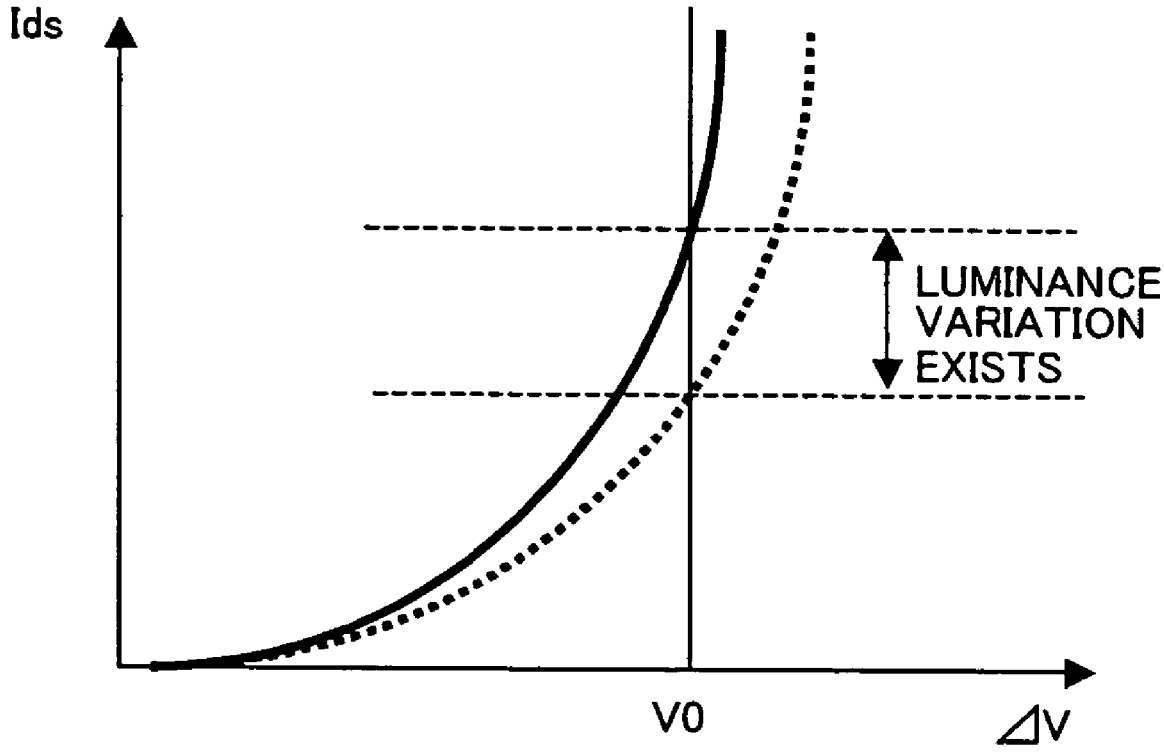
FIG. 5 is a graph of characteristic curves of ΔV (=Vgs−Vth) and the drain-source current Ids of drive transistors having different mobilities in the pixel circuit of FIG. 3.
Figure 6:
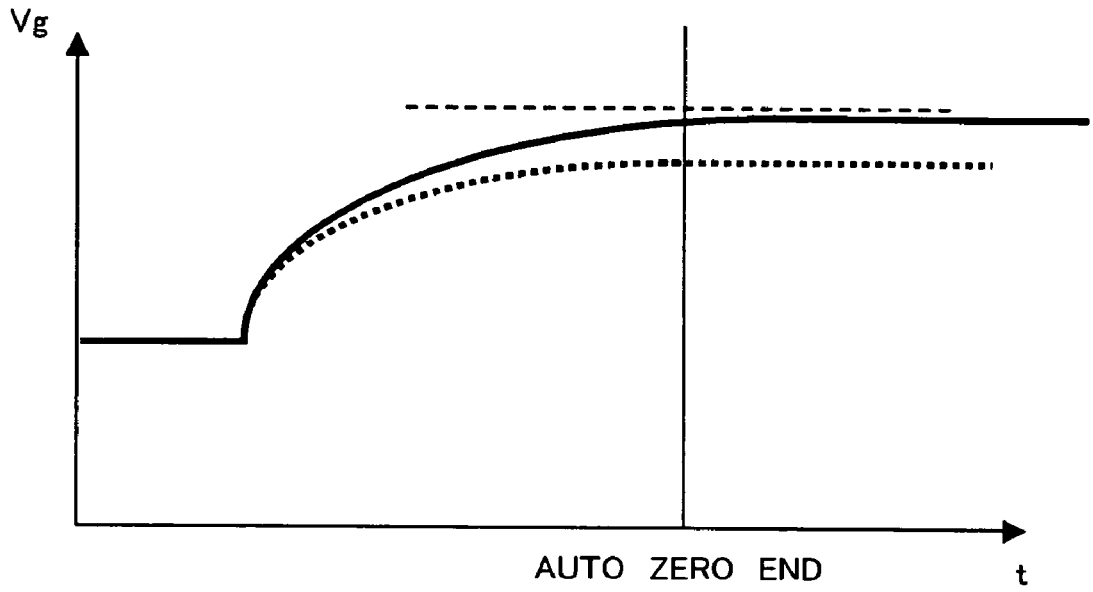
FIG. 6 is a graph of the change of the gate voltage of a drive transistor at the time of an auto-zero operation in pixels having different drive transistor threshold values Vth in the pixel circuit of FIG. 3.
Figure 7:
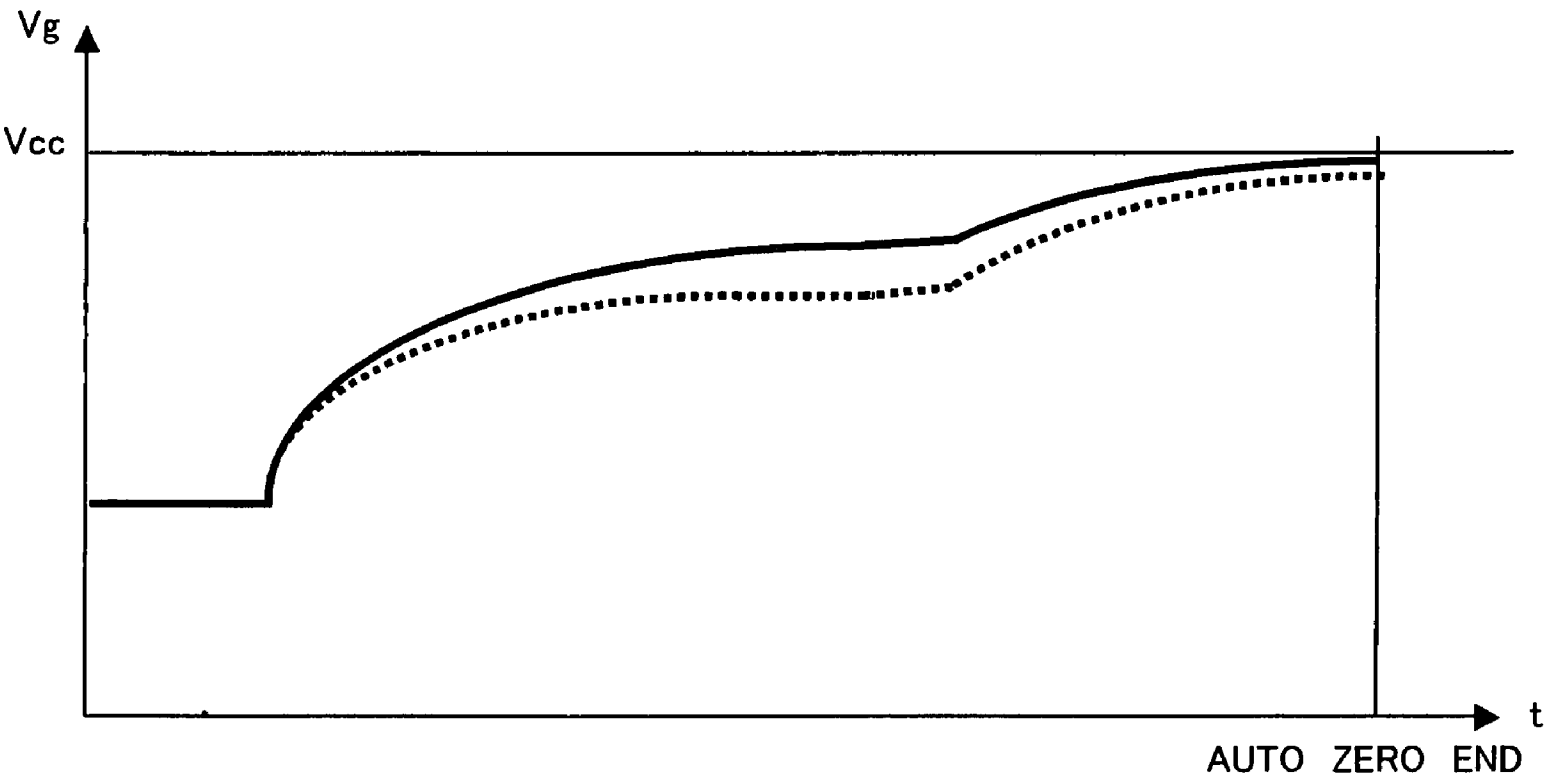

As shown in FIG. 12, as mentioned above, in the present pixel circuit, at the time of variation correction (ΔV=0), the reference current Iref flows through the drive transistor TFT 121 even at pixels having different threshold values Vth and mobilities. Thereafter, an ON current corresponding to the coupling voltage ΔV flows. The present pixel circuit basically moves the curve of the different mobility in the conventional method (FIG. 5) in parallel to make it cross the current value Iref. That is, variation of the mobility μ occurs centered about the reference current Iref. Therefore, as shown in FIG. 13, variation of the ON current due to variation of the mobility at the time of the white display is suppressed. Due to this, an organic EL display having a better uniformity is obtained.

FIG. 13 is a graph of the change of the gate voltage of a drive transistor at the time of an auto-zero operation in pixels C and D having different drive transistor threshold values Vth. In FIG. 13, the abscissa represents the time t, and the ordinate represents the gate voltage Vg. Further, in FIG. 13, the curve indicated by the solid line shows the characteristic of the pixel C, and the curve indicated by the broken line shows the characteristic of the pixel D.

As explained above, in each pixel circuit, the gate potential Vg of the TFT 121 is determined so that the reference current Iref flows, and the variation of the threshold value Vth is cancelled. Since the variation of the threshold value Vth is cancelled while the reference current Iref flows as it is in this way, the time up to the cancellation of the Vth variation may be shorter than that in the conventional method, the cancellation of the variation of the threshold value Vth will not become incomplete, and deterioration of the uniformity will not occur. Further, even after canceling out the variation of the threshold value Vth, so long as the TFT 125 is held in the conductive state, the reference current Iref will continuously flow, and, as shown in FIG. 13, the gate voltage will be continuously held. That is, since the gate voltage is continuously held in the pixel circuit, the gate voltage will be held with the variation of the threshold value Vth as corrected. Due to this, even in a panel having a different threshold value Vth, the threshold value Vth will be corrected without regard as to the time of setting the auto-zero operation. As a result, the uniformity will be enhanced.

Further, in the present embodiment, since the voltage drive type organic EL display device canceling out variation in the threshold value Vth using the reference current Iref in this way is configured providing each pixel unit 200 comprising a plurality of pixels with a current transfer circuit 108, writing (sampling and holding) the current value once into this current transfer circuit 108, then transferring it to the pixel circuits in the pixel unit 200, the writing time to the current transfer circuit 108 can be sufficiently obtained. Further, the interconnect length of the reference current transfer line ITL101 for writing from the current transfer circuit 108 to the pixel circuits is short, therefore the interconnect capacitance is also small and the threshold value Vth can be corrected within a 1 H period in each pixel circuit. Accordingly, even in a large screen panel, variations of the threshold values Vth and the mobilities μ in the pixels are cancelled out and an image quality having a good uniformity can be obtained.

Here, consider a write operation when the threshold values Vth of the drive transistors TFT 121 in the pixel circuits vary in relation to FIGS. 14A and 14B.

For example, as shown in FIG. 14A, consider the potential change of a A point in a reference current supply line ISL in the case of not providing any current transfer circuits, directly connecting a plurality of pixel circuits connected to the same data line of each column of the pixel array and the reference current supply line ISL101, correcting the variation of the threshold value Vth of the TFT 121-1 of the pixel circuit 101-1 of the first row, then correcting the variation of the threshold value Vth of the TFT 121-2 of the pixel circuit 101-2 of the second row.

For example, assume that Iref=2 μA and the TFT 121-1 of the pixel circuit 101-1 of the first row and the TFT 121-2 of the pixel circuit 101-2 of the second row have threshold values Vth of 2.0V and 2.3V, that is, a difference of 0.3V. Due to this variation of the threshold value Vth, the gate voltage of the drive transistor TFT 121-1 of the pixel circuit 101-1 of the first row with respect to the reference current Iref becomes 8.0V, and the gate voltage of the TFT 121-2 of the second row becomes 7.7V. That is, the potential (A) of the reference current supply line ISL will change from 8.0V to 7.7V. FIG. 14B shows the operation state at the time of this potential change.

As the path of the current flowing when the potential of the A point changes, there are paths of currents I0, I1, and I2 of FIG. 14B. These become Iref=2 μA=I0+I1+I2 based on the Kirchhoff theory. I0 becomes the current flowing through the drive transistor TFT 121-2, I1 becomes the current flowing out of the pixel capacity C121-2, and I2 becomes the current flowing out of the capacitance Csig of the reference current supply line ISL. Here, it is necessary to discharge the C121 and Csig from 8.0V to 7.7V. At the first when the TFT 125-2 turns on, the gate voltage of the TFT 121-2 is 8.0V since the potential of the point A is written, and a current smaller than 2 μA flows as I0. The C121-2 and Csig are discharged by the current of the amount of the difference, and the gate voltage of the TFT 121-1 and the potential of the point A approach 7.7V. However, as the gate voltage approaches 7.7V, I0 becomes about 2 μA and both I1 and I2 become very small values. It is necessary to discharge the C121-2 and Csig with these small currents. A long time is required until they are completely discharged to 7.7V.

Particularly, when the panel becomes large sized, the capacitance Csig of the reference current supply line ISL increases. That is, a very long time is required for the transition of the gate voltage at the stage where the threshold values Vth differ. As shown in FIG. 14A, when providing one reference current supply line ISL for one column of pixels, it is necessary to correct the variation of the threshold value Vth of the drive transistor constituted by the TFT 121 within a 1 H period, but when the panel is large sized, the correction of the variation of the threshold value Vth may not be ended within the 1 H period.

As opposed to this, since the present embodiment is configured forming a plurality of (for example 20) pixel units 200 each comprising a plurality of the pixel circuits among a plurality of (for example 800) pixel circuits 101 arranged in the same column of the pixel array and connected to the same data line DTL, providing a current transfer circuit 108 in each pixel unit 200, connecting this current transfer circuit 108 and the reference current supply lines ISL101 to ISL10*n*, sampling and holding the reference current Iref at the current transfer circuit 108 for every pixel unit, and sequentially supplying it to the pixel circuits 101 in that pixel unit 200 through the reference current transfer line ITL101 for every horizontal scanning period, the writing time to a current transfer circuit 108 can be sufficiently obtained. Further, since the interconnect length of the reference current transfer line ITL101 for writing from the current transfer circuit 108 to each pixel circuit is short, the interconnect capacitance is also small and the threshold value Vth can be corrected in a 1 H period in each pixel circuit. As a result, variation of the threshold values Vth in the pixel circuits can be reliably cancelled out even if the panel is large sized, and an image quality having a good uniformity can be obtained even in a large sized screen.

Further, according to the present embodiment, since the reference current line is connected to the drive transistor of each pixel through a switch and the variation of the threshold values Vth is corrected, variation of the ON current due to the mobility at the time of a so-called white display can be suppressed, and the uniformity with respect to variation in the mobility can be greatly enhanced in comparison with the conventional method. Further, since variation of the threshold values Vth is cancelled by supplying the reference current Iref, the time taken for the cancellation of the variation of the threshold values Vth is shortened in comparison with the conventional case, and deterioration of the uniformity due to the variation of the threshold values Vth can be prevented. Further, once the variation of a threshold value is cancelled, the gate potential does not fluctuate after that, therefore, the time of auto-zero operation does not depend upon the absolute value of the threshold value Vth and the increase of the number of steps due to the setting of the auto-zero time can be suppressed.

Note that, the configuration of the current transfer circuit is not limited to the circuit shown in FIG. 9. For example, it is also possible to employ, as shown in FIG. 15, a current transfer circuit 108A configured cascade-connecting (two-stage series connecting) to a constant current source circuit comprising TFT 131 and TFT 132 and the capacitor C131 a constant current source circuit comprised of n-channel TFTs 135 and 136 between the node ND131 and the ground potential GND or, as shown in FIG. 16, a leakage elimination circuit comprised of diode connected p-channel TFT 137 and n-channel TFT 138 serving as a switch in addition to the configuration of FIG. 15.

In the current transfer circuit 108A of FIG. 15, the source of the TFT 131 serving as the second field effect transistor is connected to the node ND133 in place of the ground potential GND, the drain of the TFT 135 serving as the first field effect transistor is connected to the node ND133, and the source of the TFT 135 is connected to the ground potential GND. The gate of the TFT 135 is connected to the node ND134. Further, the source and the drain of the TFT 136 serving as the eighth switch are connected to the node ND133 and the node ND134, and the gate of the TFT 136 is connected to the scanning line WSL141 selectively driven by for example a not illustrated fifth write scanner. The first electrode of the capacitor C132 is connected to the node ND134, and the second electrode is connected to the ground potential GND.

In the current transfer circuit 108A of FIG. 15, the fourth write scanner 111 makes the signal S134 to the scanning line WSL131 the low level and makes the TFT 134 the nonconductive state. In this state, the signals S132, S133, and S136 to the scanning lines WSL111, WS121, and WSL141 are made the high level, and the TFT 132, TFT 133, and TFT 136 are made the conductive state for a period of 20 H. Along with the TFT 133 becoming the conductive state, the reference current Iref flows in the current transfer circuit 108A. At this time, the TFT 131 has its gate and drain connected via the TFT 132 and operates in the saturated region. The gate voltage thereof is determined based on equation 1 and held in the capacitor C131. In the same way, the reference current is supplied to the node ND133 via the TFT 131. At this time, the TFT 135 operates in the saturated region via the TFT 136. The gate voltage thereof is determined based on equation 1 and is held in the capacitor C132. In this way, after a predetermined gate voltage is written into the capacitors C131 and C132 and the interconnect capacitance Csig of the reference current supply line ISL 101, the signal S136 to the scanning line WSL141 is made the low level to make the TFT 136 the nonconductive state, then the signal S132 to the scanning line WSL111 is made the low level to make the TFT 132 the nonconductive state, then the signal S133 to the scanning line WSL121 is made the low level to make the TFT 133 the nonconductive state. Then, the signal S134 to the scanning line WSL131 is made the high level to hold the TFT 134 in the conductive state for the 20 H period. Due to this, the reference current Iref is sampled and held at the current transfer circuit 108A and output to the reference current transfer line ITL101.

By cascade connecting the constant current source circuits in series as in the current transfer circuit 108A of FIG. 15, the variation of the potential of the node ND133 (point A) (the drain voltage of the TFT 135) is suppressed and a constant current source without variation of the output current due to the Early effect can be achieved.

In the current transfer circuit 108B of FIG. 16, the source of the TFT 137 is connected to the supply line of the power supply voltage Vcc, and the gate and the drain of the TFT 137 are connected. Namely, the TFT 137 is diode-connected. Further, the source and the drain of the TFT 138 are connected to the connecting point of the gate and the drain of the TFT 137 and the node ND131, and the gate of the TFT 138 is connected to the WSL151 by for example a not illustrated sixth scanning line.

In the current transfer circuit 108B of FIG. 16, the fourth write scanner 111 makes the signal S134 to the scanning line WSL131 the low level and makes the TFT 134 the nonconductive state. In this state, the signals S132, S133, and S136 to the scanning lines WSL111, WS121, and WSL141 are made the high level, and the TFT 132, TFT 133, and TFT 136 are made the conductive state for the period of 20 H. Along with the TFT 133 becoming the conductive state, the reference current Iref flows in the current transfer circuit 108B. At this time, the TFT 131 has its gate and drain connected via the TFT 132 and operates in the saturated region. The gate voltage thereof is determined based on equation 1 and held in the capacitor C131. In the same way, the reference current is supplied to the node ND133 via the TFT 131. At this time, the TFT 135 operates in the saturated region via the TFT 136. The gate voltage thereof is determined based on equation 1 and held in the capacitor C132. In this way, after the predetermined gate voltage is written into the capacitors C131 and C132 and the interconnect capacitance Csig of the reference current supply line ISL 101, the signal S136 to the scanning line WSL141 is made the low level to make the TFT 136 the nonconductive state, the signal S132 to the scanning line WSL111 is made the low level to make the TFT 132 the nonconductive state, then the signal S133 to the scanning line WSL121 is made the low level to make the TFT 133 the nonconductive state. Then, the signal S134 to the scanning line WSL131 is made the high level to hold the TFT 134 in the conductive state for the 20 H period. Due to this, the reference current Iref is sampled and held at the current transfer circuit 108B and output to the reference current transfer line ITL101. The operation up to here is the same as the operation of the circuit of FIG. 15 mentioned above.

After making the TFT 133 the nonconductive state, the signal S138 to the scanning line WSL151 is made the high level to make the TFT 138 the conductive state. This circuit carries the current Iref. The gate voltage (drain voltage) of the TFT 137 becomes a voltage corresponding to the current Iref. In this case, the size of the TFT 137 is designed so that the TFT 131 and the TFT 135 can be driven in the saturated region.

Here, consider the operation point of the TFT 131. When the TFT 138 becomes the conductive state, the drain voltage (B) of the TFT 131 ends up becoming equal to the drain voltage of the TFT 137, the source-drain voltage Vds of the TFT 131 increases (Vin→Vin'), and the value of the flowing current increases by exactly the amount of the Early effect, that is, ΔIds. However, the constant current source including the TFT 135 continuously supplies the current Iref, so the source voltage of the TFT 131 decreases so as to obtain a current value corresponding to the current Iref. However, the change of the current value due to the change of the source voltage of the TFT 131 acts as a square according to equation 1, so the source potential does not change much at all. Here, the source potential of the TFT 131 is the same as the drain potential (A) of the TFT 135. Accordingly, when cascade-connecting, the drain voltage of the TFT 135 has the value when writing the current Iref, that is, a value almost equal to the gate voltage of the TFT 135. Due to this, the source-drain voltage of the TFT 136 becomes almost 0V, and a drop of the gate voltage of the TFT 135 due to the leaked current can be greatly suppressed.

Note that, in the circuit of FIG. 16, the TFT 137 may be an n-channel TFT too.

Note that, in the present embodiment, the explanation was given of a configuration generating the reference current in a so-called display panel as the reference current source, but it is also possible to configure things to supply the reference current Iref from the outside of the panel. In this case, the reference current Iref is generated in for example an external MOSIC and input to the panel, so there is little variation of the current value for individual reference current supply lines.

Further, in the present embodiment, a configuration connecting the gate of the TFT 122 serving as the second switch and the gate of the TFT 125 serving as the fourth switch to the auto-zero line AZL101 serving as the third control line was employed, but a configuration wherein the gate of the TFT 122 serving as the second switch is connected to the first auto-zero line AZL101-2 serving as the third control line and wherein the gate of the TFT 125 serving as the fourth switch is connected to the second auto-zero line AZL101-2 serving as the fourth control line is also possible. In this way, when the TFT 123 and the TFT 125 are turned on by different control lines, the timing of turning on does not influence the auto-zero operation no matter which is earlier (later). However, the drive pulse can be decreased. Therefore, as in the present embodiment, preferably they are turned on at the same timing by a common control line.

Further, in the present embodiment, the drive was controlled so that the drive scanning and the auto-zero overlapped, but it is not always necessary to overlap them. Overlap can prevent the cut off of the drive transistor TFT 121, however. Further, in the present embodiment, the drive was controlled so that the drive scanning was turned on before the write scanning, but it is also possible that they be simultaneous or that the drive scanning be later. When turning on the drive scanning before the write scanning, the drive transistor TFT 121 is driven saturated at the time of writing the signal voltage and the gate capacitance becomes small, so it is preferable to turn on the drive scanning before the write scanning.

Summarizing the effects of the invention, as explained above, according to the present invention, the variation of the ON current due to the mobility at the time of a white display can be suppressed and the uniformity with respect to variation of the mobility can be greatly enhanced in comparison with the conventional method. Further, variation of the threshold values is cancelled by supplying by a reference current, so the time taken for the cancellation of the variation of the threshold values is shortened and the deterioration of the uniformity due to the variation of the threshold values can be prevented. Further, once the variation of the threshold values is cancelled, the gate potential of a drive transistor will not fluctuate thereafter, so the auto-zero time will not depend upon the absolute value of the threshold value, and the increase of the number of steps due to the setting of the auto-zero time can be suppressed.

Further, sufficient writing time to a current transfer circuit can be obtained. Further, the interconnect length of the reference current transfer line for writing from the current transfer circuit to each pixel circuit can be made shorter, therefore the interconnect capacitance can also be made smaller, and in each pixel circuit, the threshold value Vth can be corrected in one horizontal scanning period (1 H period). As a result, even if the panel is large sized, the variation of the threshold values Vth in the pixel circuits can be reliably cancelled out and an image quality having a good uniformity can be obtained even in a large sized screen.

As explained above, according to the present invention, a current having the desired value can be stably and accurately supplied to the light emitting element of each pixel without regard as to not only variation of the threshold values of the active elements inside the pixels, but also variation of the mobilities. As a result, it becomes possible to display a high quality image.

While the invention has been described with reference to specific embodiments chosen for purpose of illustration, it should be apparent that numerous modifications could be made thereto by those skilled in the art without departing from the basic concept and scope of the invention.

The invention claimed is:

1. A display device comprising:

a plurality of pixel circuits arranged in a matrix array, at least one data line laid for a column of the matrix array of said pixel circuits and supplied with a plurality of data signals in accordance with luminance information, a first control line laid for every row of the matrix array of said pixel circuits, first and second reference potentials, at least one reference current supply line laid for the column of the matrix array of said pixel circuits and supplied with a predetermined reference current, and a plurality of pixel units each including at least two pixel circuits of said plurality of pixel circuits, said at least two pixel circuits being arranged in a single column of the matrix array and connected to a single one of the at least one data line;

each said pixel unit including:

a reference current transfer line connected in common to the at least two pixel circuits in the pixel unit, and a current transfer circuit configured to accumulate reference currents supplied to said reference current supply line over a predetermined period and configured to transfer reference currents accumulated after an elapse of said predetermined period to said reference current transfer line;

each said pixel circuit of said at least two pixel circuits including:

an electro-optical element, first, second, and third nodes, a drive transistor forming a current supply line between a first terminal and a second terminal connected to said first node and configured to control a current flowing through said current supply line in accordance with a potential of a control terminal connected to said second node, a first switch connected to said first node, a second switch connected between said first node and said second node, a third switch connected between said single at least one data line and said third node and controlled in its conduction by said first control line, a fourth switch connected between said first node and said reference current transfer line, and a coupling capacitor connected between said second node and said third node; and the current supply line of said drive transistor, said first node, said first switch, and said electro-optical element being connected in series between said first reference potential and second reference potential.

2. A display device as set forth in claim 1, wherein said current transfer circuit comprises:

a field effect transistor including a source connected to a predetermined potential, a fifth switch connected between a drain and a gate of said field effect transistor, a sixth switch connected between the drain of said field effect transistor and said reference current supply line, a seventh switch connected between the drain of said field effect transistor and said reference current transfer line, and a capacitor connected between the gate of said field effect transistor and the predetermined potential.

3. A display device as set forth in claim 1, wherein said current transfer circuit comprises:

a first field effect transistor having a source connected to a predetermined potential, a second field effect transistor having a source connected to a drain of said first field effect transistor, a fifth switch connected between a drain and a gate of said second field effect transistor, a sixth switch connected between the drain of said second field effect transistor and said reference current supply line, a seventh switch connected between the drain of said second field effect transistor and said reference current transfer line, an eighth switch connected between the drain and a gate of said first field effect transistor, a first capacitor connected between the gate of said first field effect transistor and the predetermined potential, and a second capacitor connected between the gate of said second field effect transistor and the predetermined potential.

4. A display device as set forth in claim 2, further comprising:

a first circuit configured to make said fifth and sixth switches of said current transfer circuit conductive for a time of a multiple of a horizontal scanning period to input reference currents supplied to said reference current supply line to accumulate said reference currents in said capacitor and make said field effect transistor act as a current source and to hold said fifth and sixth switches in a nonconductive state after an elapse of time of a multiple of the horizontal scanning period to make said seventh switch conductive and to output the accumulated reference currents to said reference current transfer line, and a second circuit configured to sequentially make said fourth switches of the pixel circuits in said pixel units conductive for every horizontal scanning period to sequentially supply the accumulated reference currents from said current transfer circuit to the said reference current transfer line to the first nodes of said pixel circuits.

5. A display device as set forth in claim 3, further comprising:

a first circuit configured to make said fifth, sixth, and eighth switches of said current transfer circuit conductive for a time of a multiple of a horizontal scanning period to input reference currents supplied to said reference current supply line and accumulate said reference currents in said first and second capacitors and make said first and second field effect transistors act as current sources and to hold said fifth, sixth, and eighth switches in a nonconductive state after an elapse of time of the multiple of the horizontal scanning period to make said seventh switch conductive and output the accumulated reference currents to said reference current transfer line and a second circuit configured to sequentially make said fourth switches of the pixel circuits in said pixel units conductive for every horizontal scanning period to sequentially supply the accumulated reference currents from said current transfer circuit to the reference current transfer line to the first nodes of said pixel circuits.

6. A display device as set forth in claim 5, wherein each said current transfer circuit comprises a leakage elimination circuit configured to supply a current corresponding to said accumulated reference currents to the drain of said second field effect transistor during a period where said seventh switch is made conductive.

7. A display device as set forth in claim 4, wherein when said second circuit drives an electro-optical element of a pixel circuit of a pixel unit, as a first stage, said first switch, said second switch, and said fourth switch are made conductive for a predetermined time to electrically connect said first node and said second node and the reference current is supplied to the first node from said reference current transfer line, as a second stage, said first switch is held in the nonconductive sate and said second switch and said fourth switch are held in the nonconductive state after an elapse of the horizontal scanning period, and as a third stage, said third switch is made conductive by said first control line, said first switch is made conductive, the data signal propagated through said data line is written into said third node, then said third switch is held in the nonconductive state, and a current in accordance with said data signal is supplied to said electro-optical element.

8. A display device as set forth in claim 5, wherein when said second circuit drives an electro-optical element of a pixel circuit of a pixel unit, as a first stage, said first switch, said second switch, and said fourth switch are made conductive for a predetermined time to electrically connect said first node and said second node and the reference current is supplied to the first node from said reference current transfer line, as a second stage, said first switch is held in the nonconductive state and said second switch and said fourth switch are held in the nonconductive state after the elapse of the horizontal scanning period, and as a third stage, said third switch is made conductive by said first control line, said first switch is made conductive, the data signal propagated through said data line is written into said third node, then said third switch is held in the nonconductive state, and a current in accordance with said data signal is supplied to said electro-optical element.

9. A display device as set forth in claim 1, wherein a value of said reference current is set at a value corresponding to an intermediate color of a generated light of said electro-optical element.

10. A driving method of a display device that includes a plurality of pixel units, each of the plurality of pixel units including a plurality of pixel circuits arranged in a single column of a pixel circuit matrix array and connected to a single one of the at least one data line, each said pixel unit including:

a reference current transfer line connected in common to a plurality of pixel circuits in the pixel unit, and a current transfer circuit configured to accumulate reference currents supplied to a reference current supply line over a predetermined period and configured to transfer accumulated reference currents to said reference current transfer line after an elapse of said predetermined period, each said pixel circuit including:

an electro-optical element, first, second and third nodes, a drive transistor forming a current supply line between a first terminal and a second terminal connected to said first node and configured to control a current flowing through said current supply line in accordance with a potential of a control terminal connected to said second node, a first switch connected to said first node, a second switch connected between said first node and said second node, a third switch connected between said data line and said third node, a fourth switch connected between said first node and said reference current transfer line, and a coupling capacitor connected between said second node and said third node, and the current supply line of said drive transistor, said first node, said first switch, and said electro-optical element being connected in series between said first reference potential and a second reference potential, said driving method of a display device comprising the steps of:

accumulating the reference currents supplied to the reference current supply lines laid for every column of the matrix array of the pixel circuits for a predetermined period, transferring the accumulated reference currents to the reference current transfer line connected in common to a plurality of pixel circuits in said pixel units after the elapse of said predetermined period, and sequentially making said fourth switches in the pixel circuits in said pixel units conductive for every horizontal scanning period of a plurality of horizontal scanning periods and sequentially supplying accumulated reference currents transferred to the reference current transfer line to the first nodes of said pixel circuits.

11. A driving method of a display device as set forth in claim 10, further comprising, when driving an electro-optical element of a pixel circuit of a pixel unit:

making said first switch, said second switch, and said fourth switch conductive for a predetermined time to electrically connect said first node and said second node and supplying the reference current to the first node from said reference current transfer line, holding said first switch in a nonconductive state and holding said second switch and said fourth switch in the nonconductive state after the elapse of the horizontal scanning period, and making said third switch conductive by said first control line, making said first switch conductive, writing a data signal propagated through said data line into said third node, then holding said third switch in the nonconductive state and supplying a current in accordance with said data signal to said electro-optical element.

12. A display device comprising:

a plurality of pixel circuits arranged in a matrix array;

at least one data line laid for a column of the matrix array of said pixel circuits and supplied with a plurality of data signals in accordance with luminance information;

a first control line laid for every row of the matrix array of said pixel circuits;

first and second reference potentials;

at least one reference current supply line laid for the column of the matrix array of said pixel circuits and supplied with a predetermined reference current, and a plurality of pixel units each including at least two pixel circuits of said plurality of pixel circuits, said at least two pixel circuits being arranged in a single column of the matrix array and connected to a single one of at least one data line;

each said pixel unit including:

a reference current transfer line connected in common to the at least two pixel circuits in the pixel unit, and a current transfer circuit configured to accumulate reference currents supplied to said reference current supply line over a predetermined period and configured to transfer the reference currents accumulated after an elapse of said predetermined period to said reference current transfer line;

each said pixel circuit including:

an electro-optical element, first and second nodes, a drive transistor forming a current supply line between a first terminal and a second terminal connected to said first node and configured to control the current flowing through said current supply line in accordance with a potential of a control terminal connected to said second node, a first switch connected to said first node, a second switch connected between said single data line and said second node and controlled in its conduction by said first control line, a third switch connected between said first node and said reference current transfer line, and the current supply line of said drive transistor, and said first node, said first switch, and said electro-optical element being connected in series between said first reference potential and said second reference potential.

* * * * *